US007093660B2

(12) United States Patent
Hopper et al.

(10) Patent No.: US 7,093,660 B2
(45) **Date of Patent: *Aug. 22, 2006**

(54) WELL OPERATIONS SYSTEM

(75) Inventors: Hans Paul Hopper, Aberdeen (GB); Thomas G. Cassity, Surrey (GB)

(73) Assignee: Cooper Cameron Corporation, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/366,173

(22) Filed: Feb. 13, 2003

(65) Prior Publication Data

US 2004/0094311 A2 May 20, 2004

Related U.S. Application Data

(60) Division of application No. 09/657,018, filed on Sep. 7, 2000, now Pat. No. 6,547,008, which is a continuation of application No. 09/092,549, filed on Jun. 5, 1998, now abandoned, which is a division of application No. 08/679,560, filed on Jul. 12, 1996, now Pat. No. 6,039,119, which is a continuation of application No. 08/204,397, filed on Mar. 16, 1994, now Pat. No. 5,544,707, which is a continuation of application No. PCT/US93/05246, filed on May 28, 1993.

(30) Foreign Application Priority Data

Jun. 1, 1992 (EP) ..... 92305014

(51) Int. Cl.
*E21B 33/03* (2006.01)

(52) U.S. Cl. ..... 166/348; 166/88.4; 166/95.1; 166/368

(58) Field of Classification Search ..... 166/348, 166/368, 95.1, 88.4, 379, 89.1, 88.1
See application file for complete search history.

(56) References Cited

U.S. PATENT DOCUMENTS

| | | | | |
|---|---|---|---|---|
| 2,094,812 | A | 10/1937 | Penick et al. | 166/15 |
| 2,118,094 | A | 5/1938 | McDonough | 166/15 |
| 2,148,360 | A | 2/1939 | Lemley | 166/14 |
| 2,590,688 | A | 3/1952 | Crain | 166/15 |
| 2,889,886 | A | 6/1959 | Gould | |
| 2,965,174 | A | 12/1960 | Haeber | 166/46 |
| 3,041,090 | A | 6/1962 | Ashe et al. | 135/137 |

(Continued)

FOREIGN PATENT DOCUMENTS

EP 0 132 891 2/1985

(Continued)

OTHER PUBLICATIONS

SPE 23050 *Electrical Submersible Pumps in Subsea Completions*; Sep. 3-6, 1991; P.A. Scott, M. Bowring, B. Coleman.

(Continued)

*Primary Examiner*—Hoang Dang
(74) *Attorney, Agent, or Firm*—Conley Rose, P.C.

(57) ABSTRACT

A wellhead has, instead of a conventional Christmas tree, a spool tree in which a tubing hanger is landed at a predetermined angular orientation. As the tubing string can be pulled without disturbing the tree, many advantages follow, including access to the production casing hanger for monitoring production casing annulus pressure, and the introduction of larger tools into the well hole without breaching the integrity of the well.

104 Claims, 16 Drawing Sheets

U.S. PATENT DOCUMENTS

| | | | | |
|---|---|---|---|---|
| 3,043,371 | A | 7/1962 | Rector | 166/86 |
| 3,064,735 | A | 11/1962 | Bauer et al. | 166/66.5 |
| 3,090,640 | A | 5/1963 | Otteman et al. | 285/3 |
| 3,098,525 | A | 7/1963 | Haeber | 166/66.5 |
| 3,139,932 | A | 7/1964 | Johnson | 166/95 |
| 3,236,308 | A | 2/1966 | Leake | 166/46 |
| 3,279,536 | A | 10/1966 | Wakefield, Jr. | 166/5 |
| 3,295,600 | A | 1/1967 | Brown | |
| 3,299,958 | A | 1/1967 | Todd | 166/89 |
| 3,310,107 | A | 3/1967 | Yancey | |
| 3,331,437 | A | 7/1967 | Jones | 166/6 |
| 3,332,481 | A | 7/1967 | Wakefield | 166/6 |
| 3,414,056 | A | 12/1968 | Brown et al. | 166/89 |
| 3,437,149 | A | 4/1969 | Cugini et al. | 166/315 |
| 3,454,084 | A | 7/1969 | Sizer | 166/6 |
| 3,457,992 | A | 7/1969 | Brown | 166/6 |
| 3,542,125 | A | 11/1970 | Sizer | |
| 3,545,541 | A | 12/1970 | DeVries | 166/95 |
| 3,552,903 | A | 1/1971 | Townsend | 166/5 |
| 3,602,303 | A * | 8/1971 | Blenkarn et al. | 166/360 |
| 3,638,725 | A | 2/1972 | Ahlstone | 166/226 |
| 3,638,732 | A | 2/1972 | Hunisinger et al. | 166/315 |
| 3,662,822 | A | 5/1972 | Wakefield | |
| 4,053,023 | A | 10/1977 | Herd et al. | 175/7 |
| 4,130,161 | A | 12/1978 | Jones | 166/337 |
| 4,154,302 | A | 5/1979 | Cugini | 166/615 |
| 4,289,199 | A | 9/1981 | McGee | 166/65 |
| 4,491,176 | A | 1/1985 | Reed | 166/65 |
| 4,629,003 | A | 12/1986 | Baugh | 166/341 |
| 4,903,774 | A | 2/1990 | Dykes et al. | 166/363 |
| 5,092,401 | A * | 3/1992 | Heynen | 166/89.1 |
| 5,280,766 | A * | 1/1994 | Mohn | 166/368 |
| 5,372,199 | A * | 12/1994 | Cegielski et al. | 166/368 |
| 5,544,707 | A * | 8/1996 | Hopper et al. | 166/382 |
| 5,884,706 | A * | 3/1999 | Edwards | 166/335 |
| 6,039,119 | A * | 3/2000 | Hopper et al. | 166/368 |
| 6,547,008 | B1 * | 4/2003 | Hopper et al. | 166/348 |

FOREIGN PATENT DOCUMENTS

| | | |
|---|---|---|
| EP | 0 534 584 | 3/1996 |
| EP | 0 489 142 | 1/1997 |
| GB | 1 494 301 | 12/1977 |
| GB | 2 166 775 | 5/1987 |
| GB | 2 192 921 | 1/1988 |
| SU | 625021 | 8/1978 |
| SU | 1244285 | 7/1986 |
| SU | 1659625 | 6/1991 |
| WO | 8 601 852 | 3/1986 |
| WO | 86/03/799 | 3/1986 |
| WO | 9 200 438 | 1/1992 |

OTHER PUBLICATIONS

National Oilwell (UK) Limited; *Through Bore Tree System*; Jan. 1993; St. Magnus House House.

Offshore Technology Conference (OTC 5689); *The Subsea Systems of the Argyll Area Fields*; D.S. Huber, R.C. Burnett; May 2-5, 1988; (pp. 81-90).

Offshore Technology Conference (OTC 5885); *Detail Design of a Guidelineless Subsea Satellite Completion*; H. B. Skeels, J.A. Martins, S.P. Singeethaml; May 1-4, 1989; (pp. 39-50).

Offshore Technology Conference (OTC 5887); *Deepwater Christmas Tree Development*; P.P. Alfano, C.H.N. Barbosa, M.A. Lewis; May 1-4, 1989; (pp. 57-65).

Offshore Technology Conference (OTC 6085); *High-Performance Metal-Seal System for Subsea Wellhead Equipment*; L. J. Milberger. C.F. Boehm; May 1-4, 1989; (pp. 411-422).

Offshore Technology Conference (OTC 6388); *Subsea Trees and Controls for Australian Bass Strait Development*: L. A. Gillette, R.K. Voss Jr., T. Goggans: May 7-10, 1990; (pp. 391-397).

Offshore Technology Conference (OTC 7065); *A High-Voltage System for Subsea Electrical Submersible Pumping*; Neil Duncan, P.A. Scott, E.R. Schweim.; May 4-7, 1992; (pp. 701-705).

SPE 16847; *Equipment Selection Procedure for Subsea Trees*; J. D. Otten, N. Brammer; Sep. 27-30, 1987: (pp. 121-130).

SPE 19288: *Don A Cost Effective Approach to Subsea Design*: B. Stoddard, J.J. Campbell; Sep. 5-8, 1989; (pp. 1-11).

American Petroleum Institute; RP 17A; *Recommended Practice for Design and Operation of Subsea Production Systems*: American Petroleum Institute 1987; (p. 88) In particular See pp. 15-20.

The American Society of Mechanical Engineers; *The Development of the 7-1/16 Through-Bore Christmas Tree*, D.S. Hubner, et al.; (undated); (pp. 99-106).

Underwater Technology Conference; *Subsea Production Systems: The Search for Cost-Effective Technology*; Mar. 19-21, 1990; (p. 15).

Division of Petroleum Engineering and Applied Geophysics, NTH; *Simplified Subsea System Design*; Oct. 23-27, 1989; (pp. 2-32).

Subsea Intervention Systems Ltd.; *Subsea Applications for Downhole Pumping*; M. Bowring, et al; DOT 1991; (pp. 71-78).

Design Certification Manuals; Jul. 29, 1986.

Subsea Wells; A Viable Development Alternative; *Ocean Industry*; Nov. 1986 (p. 1).

SPE 11176: *New Generation 18-3/4-in.-15,000-psi Subsea Wellhead System*; Sep. 26-29, 1982; B.F. Baugh, C.R. Gordon, G.C. Weiland.

National Supply Company (UK) Limited; *Through Bore Tree system and Workover Riser 7-1/16 5000 psi*; Jun. 1985.

National Supply Company (UK) Limited; *Through Bore Tree system and Workover Riser 7-1/16-5M*; Oct. 1985.

OTC 5847; *Subsea Template and Trees for Green Canyon Block 29 Development*; May 2-5, 1988; M.L. Teers, T.M. Stroud, A.J. Masciopinto.

OTC 5809; *Critical Points for the Project of Very Deep Subsea Completions*; May 2-5, 1988; J.M. Formigli Filho, O.J.S. Ribeiro.

Oil & Gas Journal; *Completion Techniques Report*; B.F. Baugh; 1989.

Oil & Gas Journal; *Offshore Report*; B.F. Baugh; May 1989.

*Concentric Tubing Hanger Designs for BP's Universal Subsea Wellhead*; H.P. Hopper; undated.

SPE 23145; *Installation of Concentric Subsea Completions From a Jack-Up in the Welland Field: A Case History*; Sep. 3-6, 1991; R. O. Sanders (pp. 405-415) (15 sheets drawings).

SPE 23045; *Snorre Subsea Tree and Completion Equipment*; Sep. 3-6, 1991; J.D. Williams, S. Ytreland: (pp. 149-157).

SPE 16847; *Equipment Selection Procedure for Subsea Trees*; Sep. 27-30, 1987; J.D. Otten, N. Brammer; (pp. 121-130).

Mathias Owe; Div. Of Machine Design; *Electrical Submersible Pump for Subsea Completed Wells*; Dec. 1991; (pp. 2).

The Nordic Council of Ministers Program for Petroleum Technology; *Electric Submersible Pump for Subsea Completed Wells*; Nov. 26-27, 1991; S. Sangesland; (pp. 17).

Declaration of Roger Moore regarding the Amoco engineering study; 1989.

The American Oil & Gas Reporter; Special Report: Offshore & Subsea Technology; *Horizontal Tree Gives Access to Subsea*; Jun. 1996.

SPE 13976 *Through Bore Subsea Christmas Trees*; Sep. 1985; D.S. Huber, G. F. Simmers and C. S. Johnson.

OTC 7063 IUHUA11-1 Field Development; *An Innovative Application of Technology*; May 1992; A. R. Baillie and Jing Hui Chen.

National Well Control Systems—ARMCO National Supply Co.; 1982-83 Composite Catalog.

National Subsea Equipment; 1986-87 Composite Catalog.

HYDRILL Mechanical Products Division; 1986-87 Composite Catalog.

American Petroleum Institute; API Recommened Practice 17A Second Edition, Sep. 1996 (Effective Date: Dec. 1, 1996); *Recommended Practice for Design and Operation of Subsea Production Systems*.

Division of Petroleum Engineering and Applied Geophysics; NTH. Trondheim: Mar. 1990; *A Simplified Subsea System Design*; Sigbjorn Sangesland; (pp. 1-18).

Cameron Iron Works USA, Inc.; *Subsea Completion System with Downhole—ESP Conceptual Design Study*; Feb. 1990; (pp. AMO 02992-AMO 03130).
Document No. SSP-020-001 and 2; SISL Project Team; *Subsea Submersible Pumping Project Task Series 1000 Equipment Evaluations*, (p. KAS09939-KAS10023); Undated.
Document No. SSP-020-021; Subsea Intervention Systems Ltd.; *Subsea Submersible Pumping Project*: Final Report vols. 1, 2 and 3; (pp. KAS10024-KAS10678); Mar. 1992.
Cooper Oil Tool; *Phillips Petroleun Company Ann Subsea Facility*; TMH0445, Nov. 1991; (pp. CCH 36064-36223).
SISL Subsea Submersible Pumping (S.S.P.), *Second Interim Report-Technical Jun. 1991, Project No. TH/03328/89; Projects of Technological Development in the Hydrocarbons Sector* (*Regulation EEC 3639/85*); *KAS 10837-10970; Jun. 1991*.
Vetco Gray; Drawings of Shell Tazerka MSP Production Tree with Tubing Hanger Spool; (1 page); undated.
Cooper Cameron; Layout Drawing of Spool Tree Arrangement for Texaco; (1 page); undated.
Cooper Cameron; Drawing of ESP Tree Arrangement for Amoco; (1 page); Dec. 18, 1989.
Cooper Cameron; Drawings of Production System Assembly—Electrical Submersible Pump for Amoco Orient re: Liuhua 11-1; (2 pages); undated.
Framo Engineering; Drawings of ESP Subsea System; (2 pages); undated.
National Oilwell Bulletin No. 186; *Mudline Subsea Completion Systems*; (4 pages); 1991.
Letter from Kvaener Oilfield Products dated Jan. 16, 1998 re: Spool Tree Continuation Patent Application.
Document No. SSP-020-004; Vetco Gray; *Conceptual Design Report Task Series 2000*; Jan. 1992.
John R. Keville letter to Lester L. Hewitt; Jan. 14, 1999 (2 p.).
Declaration of Sigbjorn Sangesland; Undated; (13 p.).
Subsea Production Technology; Oct. 23-29, 1989 and Nov. 20-24 1989; (3 p.).
Subsea 91 International Conference, Delegate & Exhibitor List 1991 (7 p.).
Claim Chart for Claim 10: Undated; (3 p.).
Technical Opinion by Bruce C. Volkert; Jan. 10, 1999; (11 p.).
John R. Keville letter to Lester L. Hewitt; Feb. 5, 1999; (8 p.).
Claim Charts for Claims 16, 112, 110, 91; Undated; (8 p.).
Annotated Figures 1-3; Undated; (3 p.).
Cooper Cameron Admissions 152-153; Undated; (1 p.).
Deposition of Normal Brammer; Sep. 18, 1998; (5 p.).
Deposition of Peter Scott; Sep. 18, 1998; (5 p.).
Claim Charts for Claims 16, 112, 91 (4 p.).
Declaration of Sigbjorn Sangesland; Undated; (76 p.).
Claim Chart for Claim 110; Undated; (1 p.).
Cooper Cameron Admissions 126-133; Undated; (5 p.).
Deposition of Peter Doyle; Jul. 28, 1999; (pp. 131-142, 179-182).
Deposition of Norman Brammer; (pp. 159-166).
Memorandum and Order; Feb. 19, 1999; (29 p.).
Memorandum and Order; Entered Apr. 16, 2001; (26 p.).
Notice of Litigation (2 p.); dated Nov. 20, 1997.
Supplemental Notice of Litigation (1 p.) (with attached Defendant's Supplemental Response to Plaintiff's Interrogatory No. 7; dated Jan. 7, 1998.
Second Supplemental Notice of Litigation (1 p.); dated Dec. 3, 1998.
Decision Dated May 14, 2002 of the United States Court of Appeals for the Federal Circuit; No. 01-1383-1408; *Cooper Cameron Corporation v. Kvaerner Oilfield Products, Inc.*; (pp. 1-13).
Norwegian Petroleum Directorate regulations Table of Contents and Sections 23-27, (4 p.), Jan. 20, 1997.
Norwegian Petroleum Directorate guidelines Table of Contents and Sections 2.1.3-2.3.3 and 3.2.2-3.7.1, (7 p.), Feb. 7, 1992.
Memorandum and Order; Entered May 13, 2003; (44 p.).
Defendant Kvaerner Oilfield Products, Inc.'s Brief on the Construction of the Claims of United States Patent No. 6,039,119; Sep. 26, 2002; (pp. 20) Appendix (pp. 2).
Plaintiff Cooper Cameron Corporation's Memorandum in Opposition to Kvaerner's Proposed Claim Construction; Oct. 17, 2002; (pp. 25).
Kvaerner's Reply to Plaintiff's Memorandum in Opposition to Kvaerner's Proposed Claim Construction; Oct. 31, 2002; (pp. 12).
Plaintiff Cooper Cameron Corporation's Sur-Reply Memorandum in Opposition to Kvaener's Proposed Claim Construction; Nov. 14, 2002; (pp. 15).
Plaintiff Cooper Cameron Corporation's Supplemental Memorandum in Opposition to Kvaerner's Proposed Claim Construction; Nov. 23, 2003; (pp. 12).
Kvaerner's Response to Plaintiff's Supplemental Memorandum in Opposition to Kvaerner's Proposed Claim Construction; Feb. 4, 2003; (pp. 15) (Exhibits 20-25).
Plaintiff Cooper Cameron Corporation's Supplemental Memorandum in Support of Its Motion for Summary Judgment and on Claim Construction; Mar. 10, 2003; (pp. 11).
Mathias Owe; Div. Of Machine Design; *Electrical Submersible Pump for Subsea Completed Wells*; Dec. 1991; (pp. KON 04649-04807) 2).
Findings of Fact, Conclusion of Law, and Order Findings of Fact; *In the Matter Pending Before Stanley J. Roszkowski, Arbitrator: Cooper Cameron Corporation v. Kvaerner Oilfield Products, Inc.*; Jan. 25, 2005; (pp. 25).
Communication from EPO dated Feb. 16, 2005; Appln. No. 96 101 005.5; (pp. 6.)
Decision Dated May 14, 2002 of the United States Court of Appeals for the Federal Circuit; No. 01-1383-1408; *Cooper Cameron Corporation v. Kvaerner Oilfield Products, Inc.*; (pp. 10).
Memorandum and Order; Entered Feb. 19, 1999; (44 p.).
Plaintiff Cooper Cameron Corporation's Memorandum of Law in Support of its Motion for Summary Judgment: filed Sep. 26, 2002; (59 p.).
Letter dated Nov. 10, 1997 from Stephen H. Cagle to Lester L. Hewitt; (3 p.).
Declaration of Peter J. Doyle, signed Nov. 17, 1999 (4 p.).
Letter dated Nov. 10, 1999 from Stephen H. Cagle to Lester L. Hewitt; (14 p.).
Letter dated Mar. 14, 2000 from Lester L. Hewitt to Stephen H. Cagle; (13 p.).
Defendant Kvaerner Oilfield Products, Inc.'s Opposition to Plaintiff's Motions for Summary Judgment; filed Oct. 17, 2002; (59 p.).
Expert Statement of Mark M. Newman; signed Apr. 21, 1998; (34 p.).
Supplemental Expert Statement and Declaration of Mark M. Newman; signed Oct. 1, 2002; (4 p.).
Letter dated Jan. 14, 1999 from John R. Keville to Lester L. Hewitt (2 p.); with attached Declaration of Sigbjorn Sangesland (13 p.); (undated).
Various pages of vol. 1 of Deposition of Sigbjorn Sangesland Dated Oct. 27, 1999 (10 p.); Various pages of vol. II of Deposition of Sigbjorn Sangesland Dated Oct. 28, 1999 (2 p.);, Various pages of vol. III of Deposition of Sigbjorn Sangesland Dated Oct. 29, 1999 (8 p.).
Deposition Exhibit 435; Fax dated Apr. 12, 1995 from Dave Garnham re barrier requirements; CCLE 007463-007468; (6 p.).
Declaration of Bruce C. Volkert, P.E. In Support of Defendant Kvaerner Oilfield Products, Inc.s's Opposition to Plaintiff's Motions for Summary Judgment; (14 p.).
Vol. IV of Deposition of Han Paul Hopper dated Feb. 25, 1998 (5 p.).
Vol. III of Deposition of Thomas Gus Cassity, dated Jul. 7, 1998 (pp. 579, 599-601); vol. 1 of Deposition of Thomas Gus Cassity, dated May 28, 1998 (pp. 90-91; Amendment Sheet (1 p.); Reporter's Certification (p. 246).
Expert Report of Benton F. Baugh; (undated) (pp. 2-12).
Letter dated Apr. 20, 1993 from B V G Manning to Kerr-McGee Oil (UK) Ltd.; re: Gryphon Project GDP-9201 (1 p.); with various answers to questions asked by HSE; (CCLE 000281-CCLE 000288).
Fax Sheet from Bruce Manning to Bart Boudreaux; dated Jun. 21, 1993 re: *Operational Procedure* (1 p.).

Deposition of Benton F. Baugh, Ph.D., P.E., dated Aug. 25, 1998 (pp. 220-225 and 294) and Corrections to Aug. 25, 1998 Deposition (3 p. and p. 293; 295, 296).
Declaration of Frank Close dated Oct. 8, 2002 (1 p.); with Tab "A" attached including a Cameron drawing.
Declaration of David Lorimer dated Oct. 7, 2002, with Tab "A", Drawing PD002616-2618; Tab "B", J.S. Horne letter dated Sep. 19, 1991 with drawing; Tab "C", amended drawing by Cooper (drawing PD0002616A); Tab D; Minutes of Meeting of Jun. 11, 1991 (2 p.).
Fax dated Aug. 20, 1991 to Norman Ritchie re: Texaco Petronella Horizontal Tree Assy. (pp. CCLE 22263-CCLE 22264).
Inter-Office Correspondence Dated Feb. 13, 1992 from Larry Hoes to Distribution; re: Technical Highlights Summary, Jan. 1992; (pp. CCH 34371-CCH 34379).
Deposition Exhibit 28; Page from Hopper diary Dated Nov. 21, 1991; (1 p.).
Deposition of Stephen A. Hatton dated May 7, 1998; (pp. 24, 139, 140).
Norwegian Petroleum Directorate; *Regulation Concerning Drilling and Well Activities and Geological Data Collection in the Petroleum Activities*; 1992; (KON 04942-KON 0954).
Supplementary & Rebuttal Report of Benton F. Baugh; dated May. 13, 1998; (pp. 20).
Deposition Exhibit No. 654 dated Oct. 29, 1999 of Sangesland; (1 p.).
Letter dated Nov. 18, 1999 from John R. Keville to Lester L. Hewitt (2 p.); with attached signed Declaration of Peter J. Doyle dated Nov. 17, 1999 (4 p.).
Letter dated Dec. 17, 1999 from Lester L. Hewitt to John R. Keville; (pp. 5).
Deposition of David A. Rose dated Jan. 11, 2001; (pp. 14; 62-71; 75-76; 81-84; 115-116; 129-130; 146).
Plaintiff Cooper Cameron Corporation's Reply Memorandum in Support of its Motions for Summary Judgment; filed Nov. 7, 2002; (pp. 1-35).
Kvaerner's Surreply to Plaintiff's Reply Memorandum in Support of its Motions for Summary Judgment; filed Nov. 21, 2002; (pp. 1-26).
Vol. 1, Deposition of Sigbjorn Sangesland dated Oct. 27, 1999; (pp. 1-61).
Vol. II, Deposition of Sigbjorn Sangesland dated Oct. 28, 1999; (pp. 1-56).
Vol. III, Deposition of Sigbjorn Sangesland dated Oct. 29, 1999; (pp. 1-56).

* cited by examiner

WELL OPERATIONS SYSTEM

This is a divisional application of application Ser. No. 09/657,018 filed Sep. 7, 2000 now U.S. Pat. No. 6,547,008 which is a continuation of application Ser. No. 09/092,549 filed Jun. 5, 1998 now abandoned which is a divisional continuing application of Ser. No. 08/679,560 filed Jul. 12, 1996, now U.S. Pat. No. 6,039,119, which is a continuation of Ser. No. 08/204,397 filed Mar. 16, 1994, now U.S. Pat. No. 5,544,707, which is a continuation of PCT application PCT/US93/05246 filed on May 28, 1993, which claims the priority of European Patent Office application 92305014 filed on Jun. 1, 1992, all of the above hereby incorporated herein by reference.

Conventionally, wells in oil and gas fields are built up by establishing a wellhead housing, and with a drilling blow out preventer stack (BOP) installed, drilling down to produce the well hole whilst successively installing concentric casing strings, which are cemented at the lower ends and sealed with mechanical seal assemblies at their upper ends. In order to convert the cased well for production, a tubing string is run in through the BOP and a hanger at its upper end landed in the wellhead. Thereafter the drilling BOP stack is removed and replaced by a Christmas tree having one or more production bores containing actuated valves and extending vertically to respective lateral production fluid outlet ports in the wall of the Christmas tree.

This arrangement has involved problems which have, previously, been accepted as inevitable. Thus any operations down hole have been limited to tooling which can pass through the production bore, which is usually no more than five inch diameter, unless the Christmas tree is first removed and replaced by a BOP stack. However this involves setting plugs or valves, which may be unreliable by not having been used for a long time, down hole. The well is in a vulnerable condition whilst the Christmas tree and BOP stack are being exchanged and neither one is in position, which is a lengthy operation. Also, if it is necessary to pull the completion, consisting essentially of the tubing string on its hanger, the Christmas tree must first be removed and replaced by a BOP stack. This usually involves plugging and/or killing the well.

A further difficulty which exists, particularly with subsea wells, is in providing the proper angular alignment between the various functions, such as fluid flow bores, and electrical and hydraulic lines, when the wellhead equipment, including the tubing hanger, Christmas tree, BOP stack and emergency disconnect devices are stacked up.

Exact alignment is necessary if clean connections are to be made without damage as the devices are lowered into engagement with one another. This problem is exacerbated in the case of subsea wells as the various devices which are to be stacked up are run down onto guide posts or a guide funnel projecting upwardly from a guide base. The post receptacles which ride down on to the guide posts or the entry guide into the funnel do so with appreciable clearance. This clearance inevitably introduces some uncertainty in alignment and the aggregate misalignment when multiple devices are stacked, can be unacceptably large. Also the exact orientation will depend upon the precise positions of the posts or keys on a particular guide base and the guides on a particular running tool or BOP stack and these will vary significantly from one to another. Consequently it is preferable to ensure that the same running tools or BOP stack are used for the same wellhead, or a new tool or stack may have to be specially modified for a particular wellhead. Further misalignments can arise from the manner in which the guide base is bolted to the conductor casing of the wellhead.

In accordance with the present invention, a wellhead comprises a wellhead housing; a spool tree fixed and sealed to the housing, and having at least a lateral production fluid outlet port connected to an actuated valve; and a tubing hanger landed within the spool tree at a predetermined angular position at which a lateral production fluid outlet port in the tubing hanger is in alignment with that in the spool tree.

With this arrangement, the spool tree, takes the place of a conventional Christmas tree but differs therefrom in having a comparatively large vertical through bore without any internal valves and at least large enough to accommodate the tubing completion. The advantages which are derived from the use of such spool tree are remarkable, in respect to safety and operational benefits.

Thus, in workover situations the completion, consisting essentially of the tubing string, can be pulled through a BOP stack, without disturbing the spool tree and hence the pressure integrity of the well, whereafter full production casing drift access is provided to the well through the large bore in the spool tree. The BOP can be any appropriate workover BOP or drilling BOP of opportunity and does not have to be one specially set up for that well.

Preferably, there are complementary guide means on the tubing hanger and spool tree to rotate the tubing hanger into the predetermined angular position relatively to the spool tree as the tubing hanger is lowered on to its landing. With this feature the spool tree can be landed at any angular orientation onto the wellhead housing and the guide means ensures that the tubing string will rotate directly to exactly the correct angular orientation relatively to the spool tree quite independently of any outside influence. The guide means to control rotation of the tubing hanger into the predetermined angular orientation relatively to the spool tree may be provided by complementary oblique edge surfaces one facing downwardly on an orientation sleeve depending from the tubing hanger the other facing upwardly on an orientation sleeve carried by the spool tree.

Whereas modern well technology provides continuous access to the tubing annulus around the tubing string, it has generally been accepted as being difficult, if not impossible, to provide continuous venting and/or monitoring of the pressure in the production casing annulus, that is the annulus around the innermost casing string. This has been because the production casing annulus must be securely sealed whist the Christmas tree is fitted in place of the drilling BOP, and the Christmas tree has only been fitted after the tubing string and hanger has been run in, necessarily inside the production casing hanger, so that the production casing hanger is no longer accessible for the opening of a passageway from the production casing annulus. However, the new arrangement, wherein the spool tree is fitted before the tubing string is run in provides adequate protected access through the BOP and spool tree to the production casing hanger for controlling a passage from the production casing annulus.

For this purpose, the wellhead may include a production casing hanger landed in the wellhead housing below the spool tree; an isolation sleeve which is sealed at its lower end to the production casing hanger and at its upper end to the spool tree to define an annular void between the isolation sleeve and the housing; and an adapter located in the annular space and providing part of a passage from the production casing annulus to a production casing annulus pressure monitoring port in the spool tree, the adapter having a valve for opening and closing the passage, and the valve being operable through the spool tree after withdrawal of the isolation sleeve up through the spool tree. The valve may be provided by a gland nut, which can be screwed up and down within a body of the adapter to bring parts of the passage formed in the gland nut and adapter body, respectively, into and out of alignment with one another. The orientation sleeve for the tubing hanger may be provided within the isolation sleeve.

Production casing annulus pressure monitoring can then be set up by method of completing a cased well in which a production casing hanger is fixed and sealed by a seal assembly to a wellhead housing, the method comprising, with BOP installed on the housing, removing the seal assembly and replacing it with an adapter which is manipulatable between configurations in which a passages from the production casing annulus up past the production casing hanger is open or closed; with the passage closed, removing the BOP and fitting to the housing above the production casing hanger a spool tree having an internal landing for a tubing hanger; installing a BOP on the spool tree; running a tool down through the BOP and spool tree to manipulate the valve and open the passage; inserting through the BOP and spool tree an isolation sleeve, which seals to both the production casing and spool tree and hence defines between the sleeve and casing an annular void through which the passage leads to a production caning annulus pressure monitoring port in the spool tree; and running a tubing string down through the BOP and spool tree until the tubing hanger lands in the spool tree with lateral outlet ports in the tubing hanger and spool tree for production fluid flow, in alignment with one another.

According to a further feature of the invention the spool tree has a downwardly depending location mandrel which is a close sliding fit within a bore of the wellhead housing. The close fit between the location mandrel of the spool tree and the wellhead housing provides a secure mounting which transmits inevitable bending stresses to the housing from the heavy equipment, such as a BOP, which projects upwardly from the top of the wellhead housing, without the need for excessively sturdy connections. The location mandrel may be formed as an integral part of the body of the spool tree, or may be a separate part which is securely fixed, oriented and sealed to the body.

Pressure integrity between the wellhead housing and spool tree may be provided by two seals positioned in series one forming an environmental seal (such as an AX gasket) between the spool tree and the wellhead housing, and the other forming a production seal between the location mandrel and either the wellhead housing or the production casing hanger.

During workover operations, the production casing annulus can be resealed by reversing the above steps, if necessary after setting plugs or packers down hole.

When production casing pressure monitoring is unnecessary, so that no isolation sleeve is required, the orientation sleeve carried by the spool tree for guiding and rotating the tubing hanger down into the correct angular orientation may be part of the spool tree location mandrel itself.

Double barrier isolation, that is to say two barriers in series, are generally necessary for containing pressure in a well. If a spool tree is used instead of a conventional Christmas tree, there are no valves within the vertical production and annulus fluid flow bores within the tree, and alternative provision must be made for sealing the bore or bores through the top of the spool tree which provide for wire line or drill pipe access.

In accordance with a further feature of the invention, at least one vertical production fluid bore in the tubing hanger is sealed above the respective lateral production fluid outlet port by means of a removable plug, and the bore through the spool tree being sealed above the tubing hanger by means of a second removable plug.

With this arrangement, the first plug, takes the function of a conventional swab valve, and may be a wireline set plug. The second plug could be a stopper set in the spool tree above the tubing hanger by, e.g., a drill pipe running tool. The stopper could contain at least one wireline retrievable plug which would allow well access when only wire line operations are called for. The second plug should seal and be locked internally into the spool tree as it performs a barrier to the well when a BOP or intervention module is deployed. A particular advantage of this double plug arrangement is that, as is necessary to satisfy authorities in some jurisdictions, the two independent barriers are provided in mechanically separate parts, namely the tubing hanger and its plug and the second plug in the spool tree.

A further advantage arises if a workover port extends laterally through the wall of the spool tree from between the two plugs; a tubing annulus fluid port extends laterally through the wall of the spool tree from the tubing annulus; and these two ports through the spool tree are interconnected via an external flow line containing at least one actuated valve. The bore from the tubing annulus can then terminate at the port in the spool tree and no wireline access to the tubing annulus bore is necessary through the spool tree as the tubing annulus bore can be connected via the interplug void to choke or kill lines, i.e. a BOP annulus, so that downhole circulation is still available. It is then only necessary to provide wireline access at workover situations to the production bore or bores. This considerably simplifies workover BOP and/or riser construction. When used in conjunction with the plug at the top of the spool tree, the desirable double barrier isolation is provided by the spool tree plug over the tubing hanger, or workover valve from the production flow.

When the well is completed as a multi production bore well, in which the tubing hanger has at least two vertical production through bores each with a lateral production fluid flow port aligned with the corresponding port in the spool tree, at least two respective connectors may be provided for selective connection of a single bore wire line running tool to one or other of the production bores, each connector having a key for entering a complementary formation at the top of the spool tree to locate the connector in a predetermined angular orientation relatively to the spool tree. The same type of alternative connectors may be used for providing wireline or other running tool access to a selected one of a plurality of functional connections, e.g. electrical or hydraulic couplings, at the upper end of the tubing hanger.

The development and completion of a subsea wellhead in accordance with the present invention are illustrated in the accompanying drawings, in which.

Figure 1:
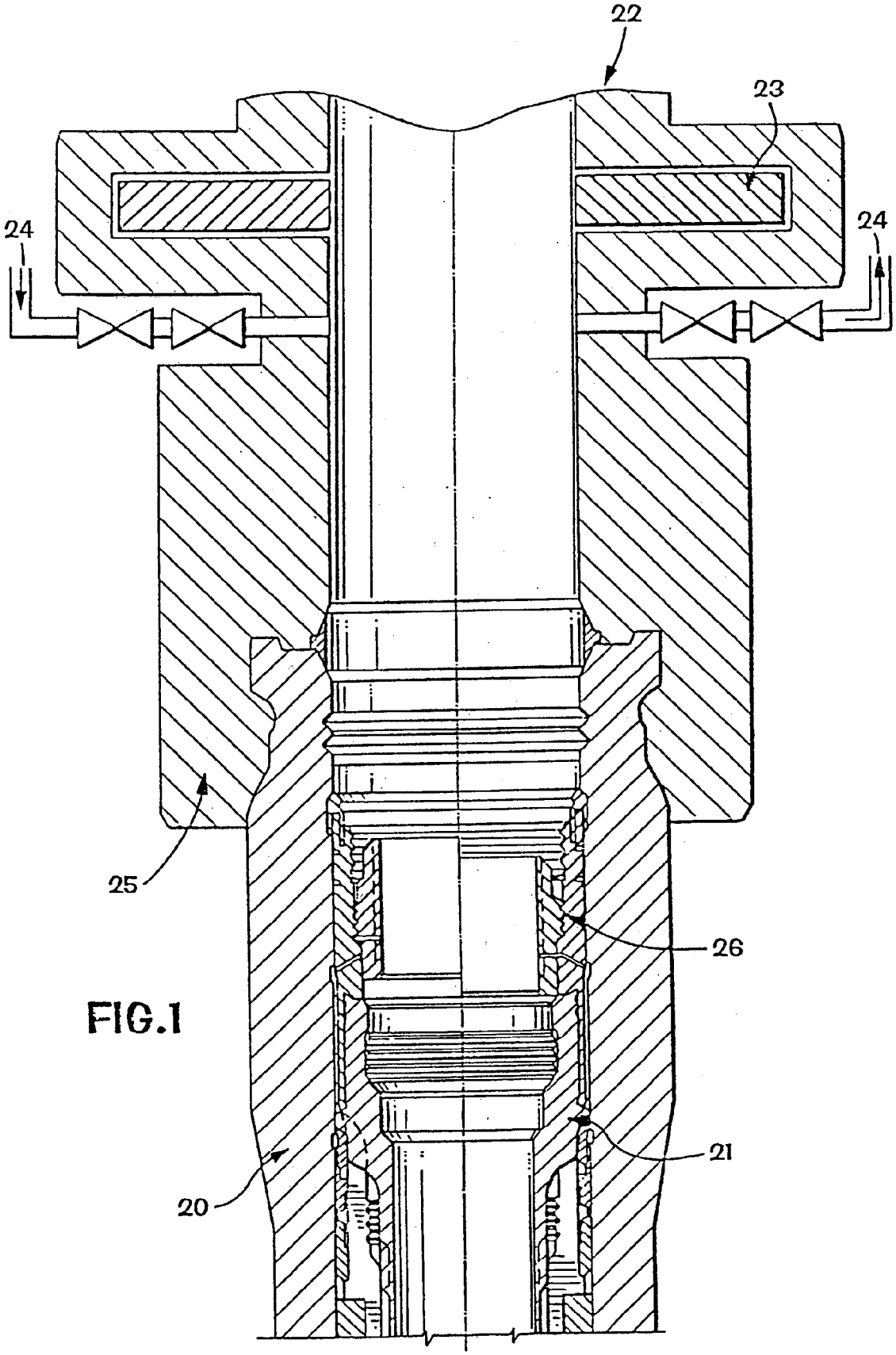
FIGS. 1 to 8 are vertical axial sections showing successive steps in development and completion of the wellhead, the Figure numbers bearing the letter A being enlargements of part of the corresponding Figures of same number without the A.

FIG. 1 shows the upper end of a cased well having a wellhead housing 20, in which casing hangers, including an uppermost production casing hanger 21 for, for example, 9⅝" or 10¾", production casing is mounted in conventional manner. FIG. 1 shows a conventional drilling BOP 22 having rams 23 and kill and choke lines 24 connected to the upper end of the housing 20 by a drilling connector 25.

Figure 1A:
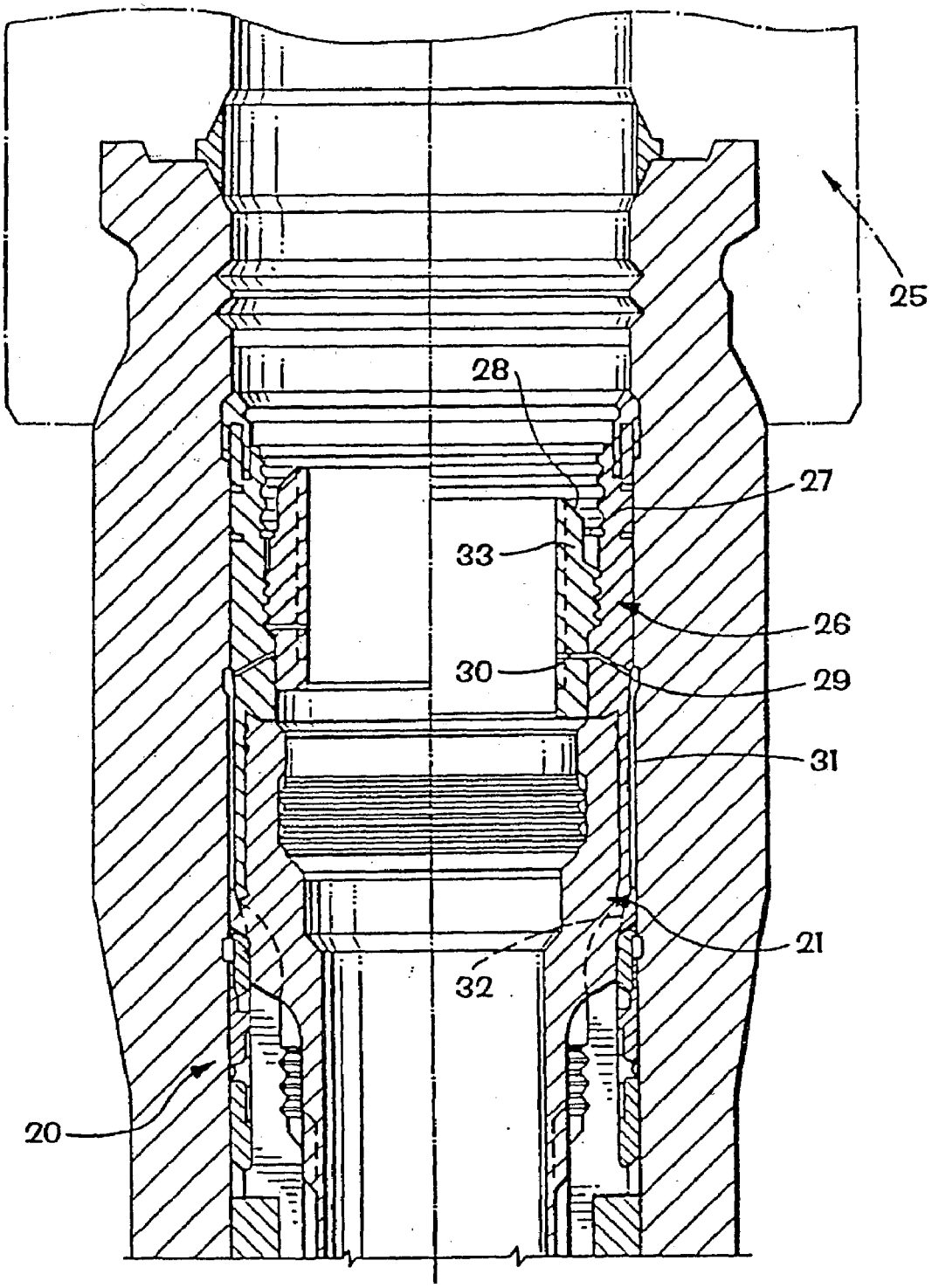

As seen in more detail in FIG. 1A, the usual mechanical seal assemblies between the production casing hanger 21 and the surrounding wellhead housing 20 have been removed and replaced through the BOP with an adapter 26 consisting of an outer annular body part 27 and an inner annular gland nut 28 which has a screw threaded connection to the body 27 so that it can be screwed between a lowered position shown on the right hand side of FIG. 1A, in which radial ducts 29 and 30, respectively in the body 27 and nut 28, are in communication with one another, and a raised position shown on the left hand side of FIG. 1A, in which the ducts are out of communication with one another. The duct 29 communicates through a conduit 31 between a depending portion of the body 27 and the housing 20, and through a conduit 32 passing through the production casing hanger 21, to the annulus surround the production casing. The duct 30 communicates through channels 33 formed in the radially inner surface of the nut 28, and hence to a void to be described. The cooperation between the gland nut 28 and body 27 of the adapter therefore acts as a valve which can open and close a passage up past the production casing hanger from the production casing annulus. After appropriate testing, a tool is run in through the BOP and, by means by radially projecting spring lugs engaging in the channels 33, rotates the gland nut 28 to the valve closed position shown on the left hand side on FIG. 1A. The well is thus resealed and the drilling BOP 22 can temporarily be removed.

Figure 2:
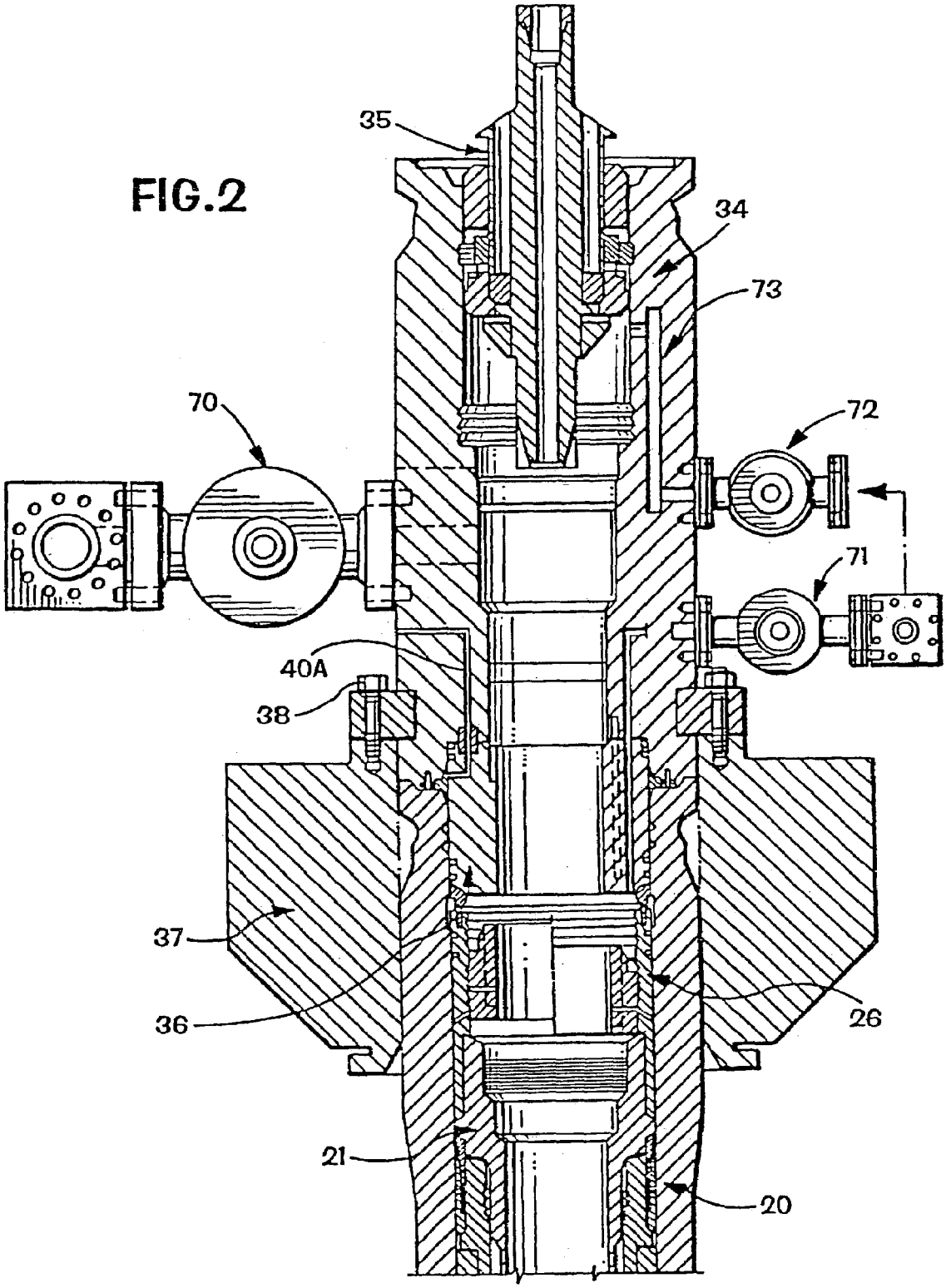
Figure 2A:
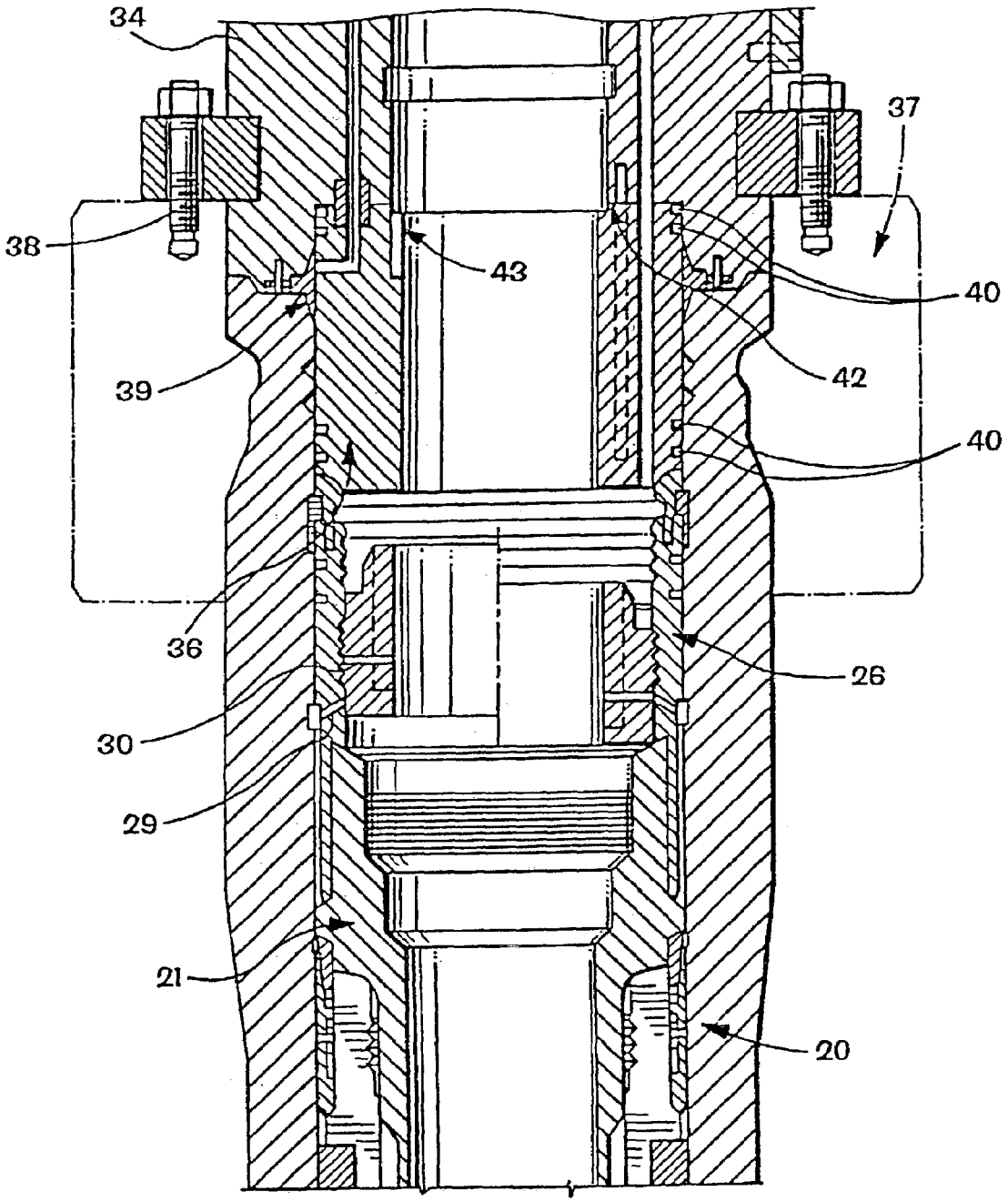

As shown in FIGS. 2 and 2A, the body of a tree spool 34 is then lowered on a tree installation tool 35, using conventional guide post location, or a guide funnel in case of deep water, until a spool tree mandrel 36 is guided into alignment with and slides as a close machined fit, into the upper end of the wellhead housing 20, to which the spool tree is then fixed via a production connector 37 and bolts 48. The mandrel 36 is actually a separate part which is bolted and sealed to the rest of the spool tree body. As seen particularly in FIG. 2A a weight set AX gasket 39, forming a metal to metal environmental seal is provided between the spool tree body and the wellhead housing 20. In addition two sets of sealing rings 40 provide, in series with the environmental seal, a production fluid seal externally between the ends to the spool tree mandrel 36 to the spool tree body and to the wellhead housing 20. The intervening cavity can be tested through a test part 40A. The provision of the adapter 26 is actually optional, and in its absence the lower end of the spool tree mandrel 36 may form a production seal directly with the production casing hanger 21. As is also apparent from reasons which will subsequently become apparent, the upper radially inner edge of the spool tree mandrel projects radially inwardly from the inner surface of the spool tree body above, to form a landing shoulder 42 and at least one machined key slot 43 is formed down through the landing shoulder.

Figure 3:
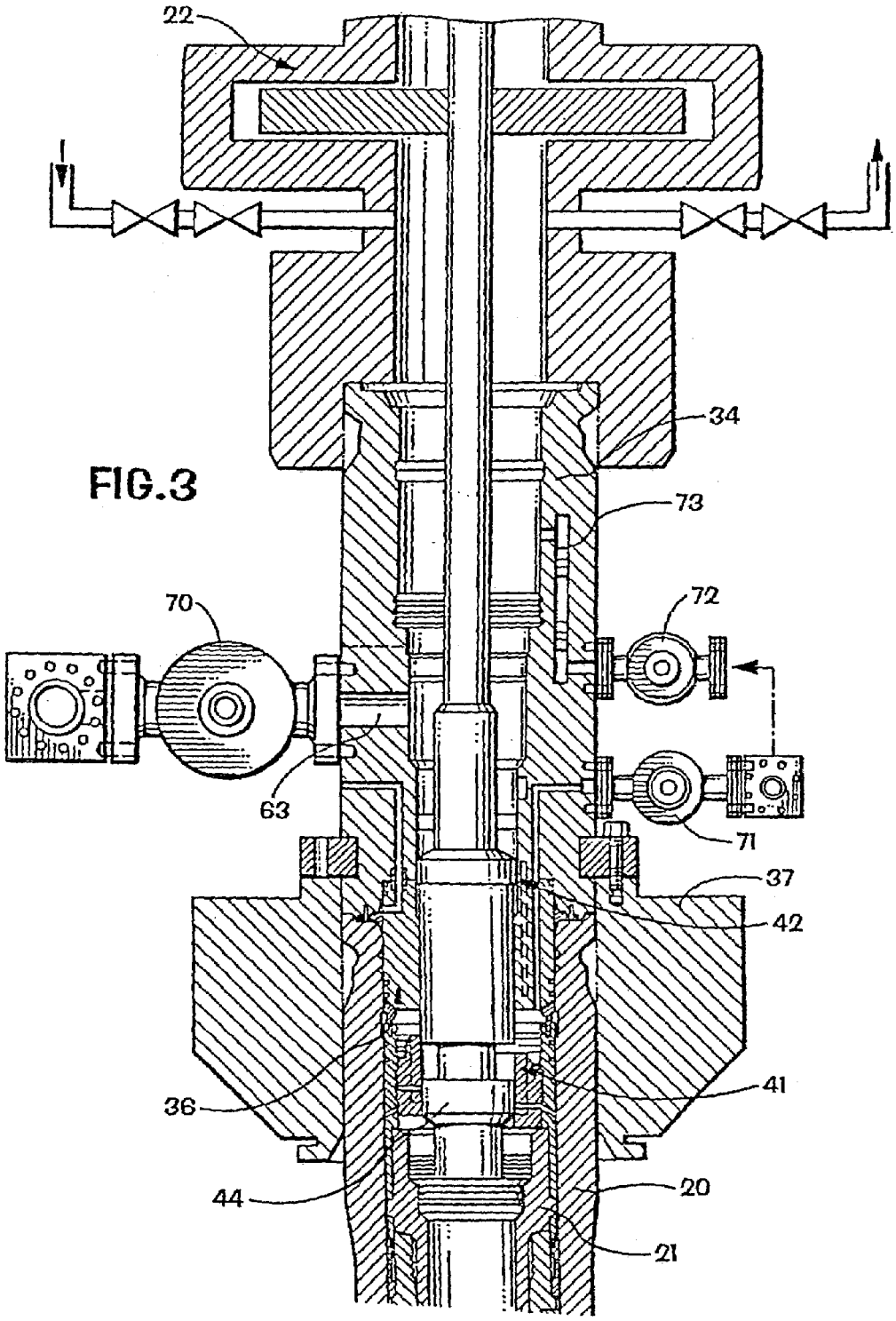

As shown in FIG. 3, the drilling BOP 22 is reinstalled on the spool tree 34. The tool 44 used to set the adapter in FIG. 1, having the spring dogs 45, is again run in until it lands on the shoulder 42, and the spring dogs 45 engage in the channels 33. The tool is then turned to screw the gland nut 28 down within the body 27 of the adapter 26 to the valve open position shown on the right hand side in FIG. 1A. It is now safe to open the production casing annulus as the well is protected by the BOP.

Figure 4:
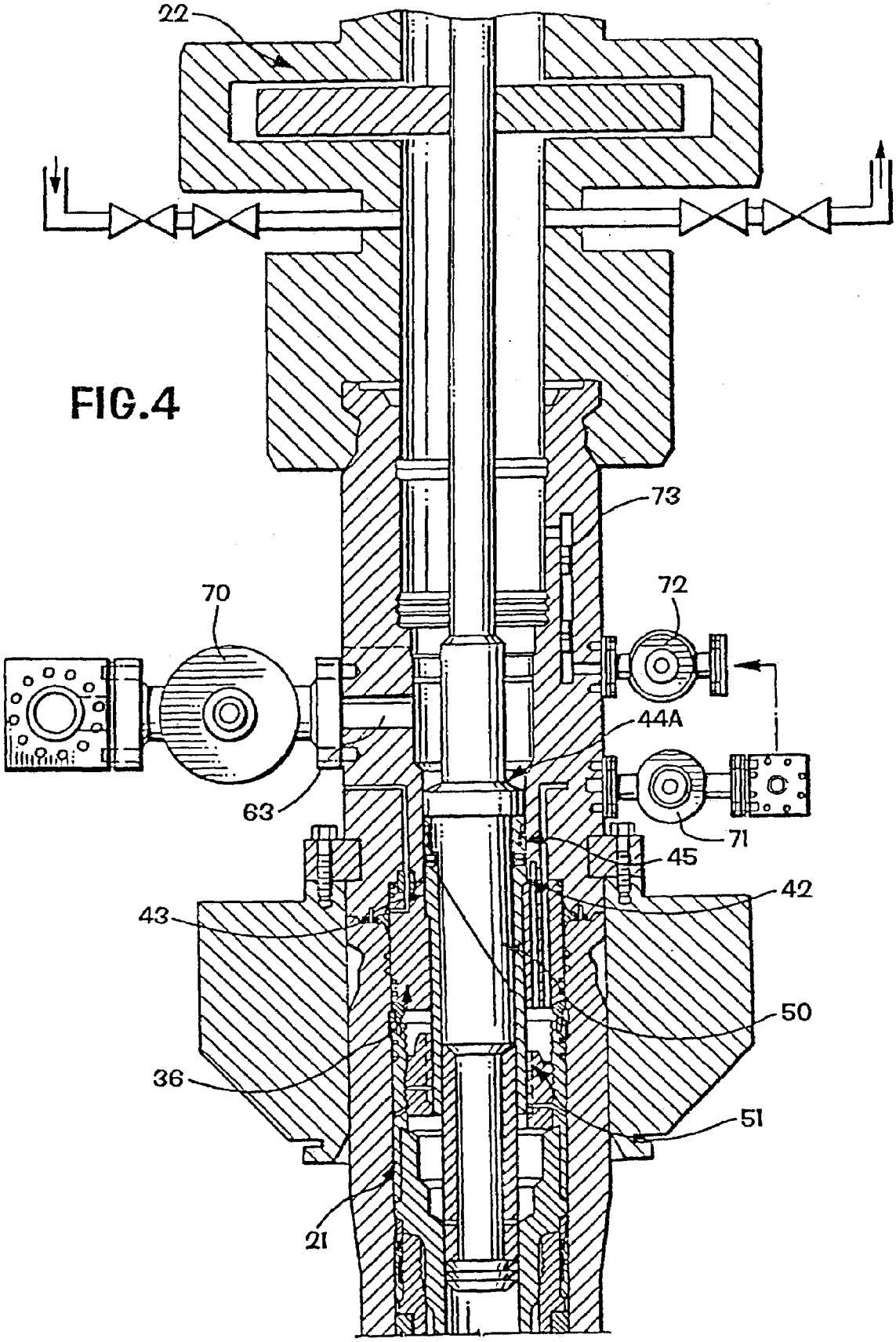
Figure 4A:
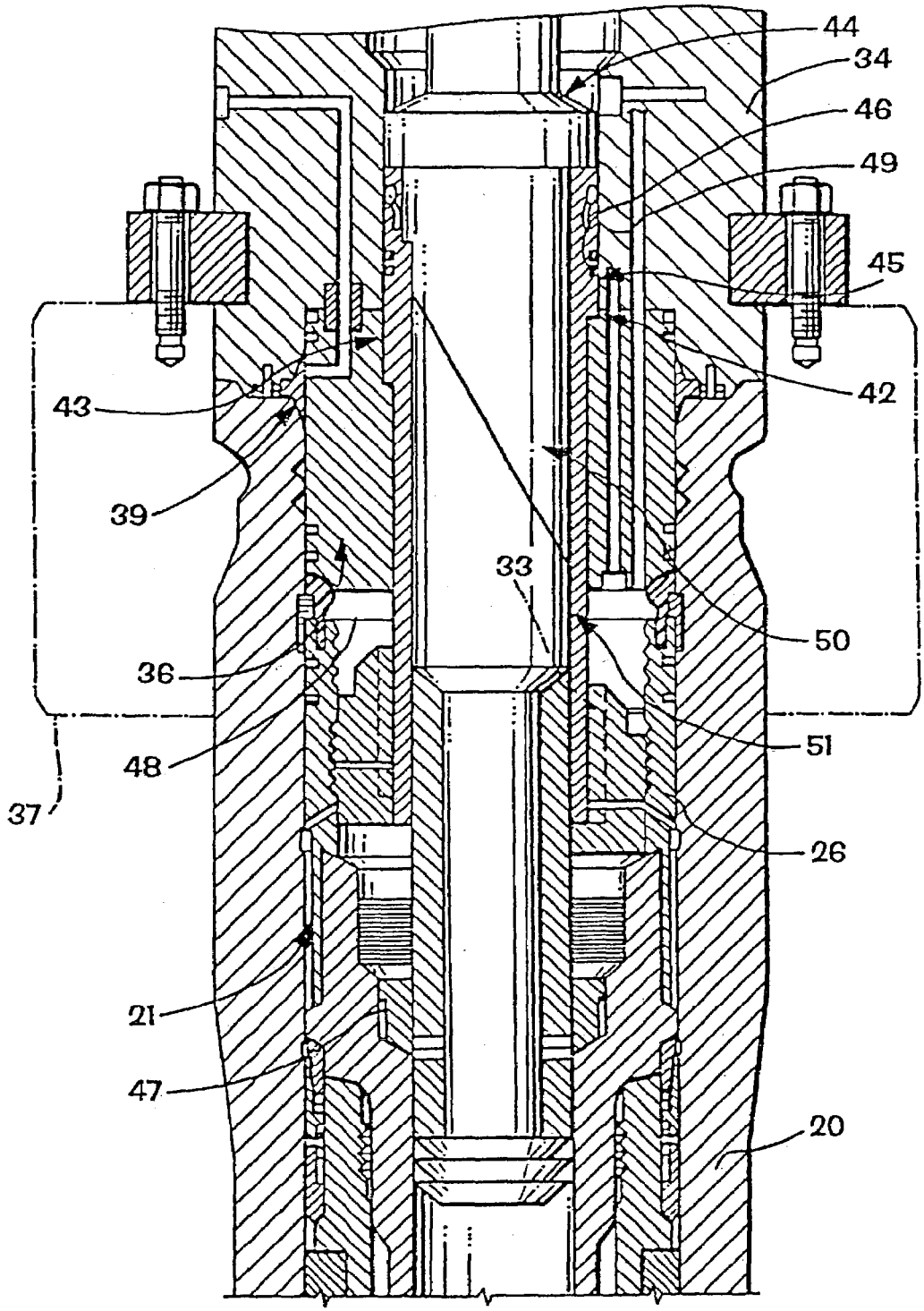

The next stage, shown in FIGS. 4 and 4A, is to run in through the BOP and spool tree on an appropriate tool 44A a combined isolation and orientation sleeve 45. This lands on the shoulder 42 at the top of the spool tree mandrel and is rotated until a key on the sleeve drops into the mandrel key slot 43. This ensures precise angular orientation between the sleeve 45 and the spool tree 44, which is necessary, and in contrast to the angular orientation between the spool tree 34 and the wellhead casing, which is arbitrary. The sleeve 45 consists of an external cylindrical portion, an upper external surface of which is sealed by ring seals 46 to the spool tree 34, and the lower external surface of which is sealed by an annular seal 47 to the production casing hanger 21. There is thus provided between the sleeve 45 and the surrounding wellhead casing 20 a void 48 with which the channels 33, now defined radially inwardly by the sleeve 45, communicate. The void 48 in turn communicates via a duct 49 through the mandrel and body of the spool tree 34 to a lateral port. It is thus possible to monitor and vent the pressure in the production casing annulus through the passage provided past the production casing hanger via the conduits 32, 31 the ducts 29 and 30, the channels 33, shown in FIG. 1A, the void 48, the duct 49, and the lateral port in the spool tree. In the drawings, the radial portion of the duct 49 is shown apparently communicating with a tubing annulus, but this is draftsman's license and the ports from the two annuli are, in fact, angularly and radially spaced.

Within the cylindrical portion of the sleeve 45 is a lining, which may be fixed in the cylindrical portion, or left after internal machining of the sleeve. This lining provides an orientation sleeve having an upper/edge forming a cam 50. The lowermost portion of the cam leads into a key slot 51.

Figure 5:
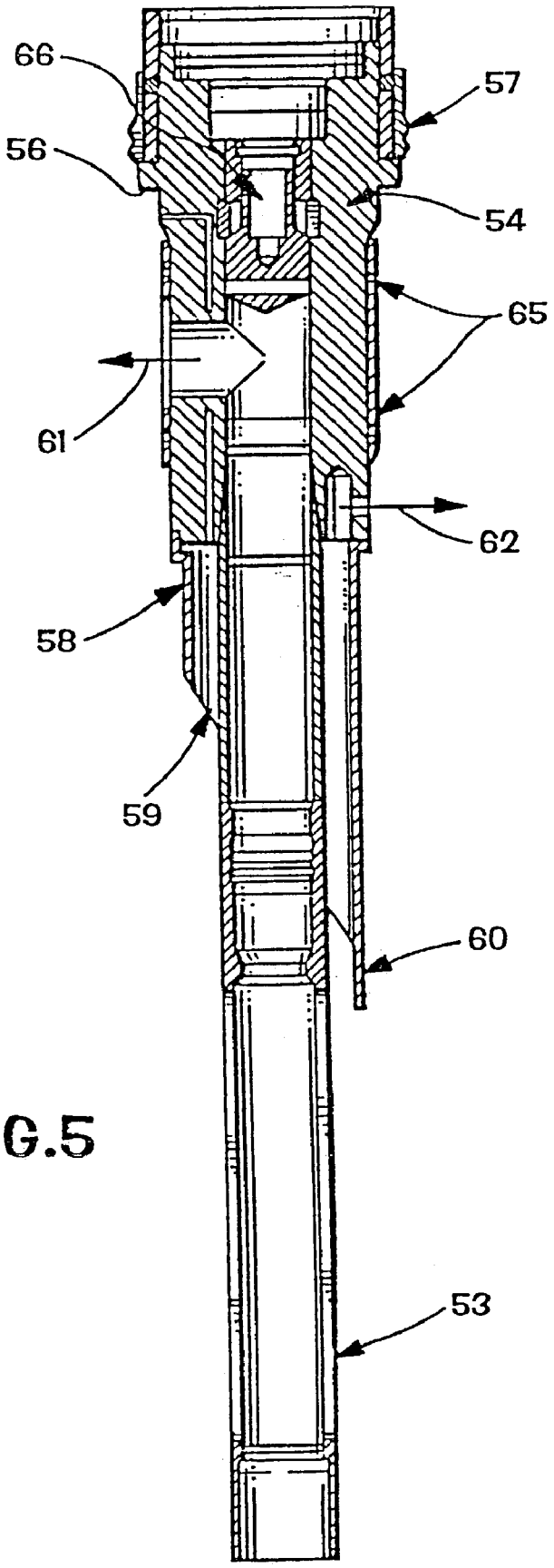
Figure 6:
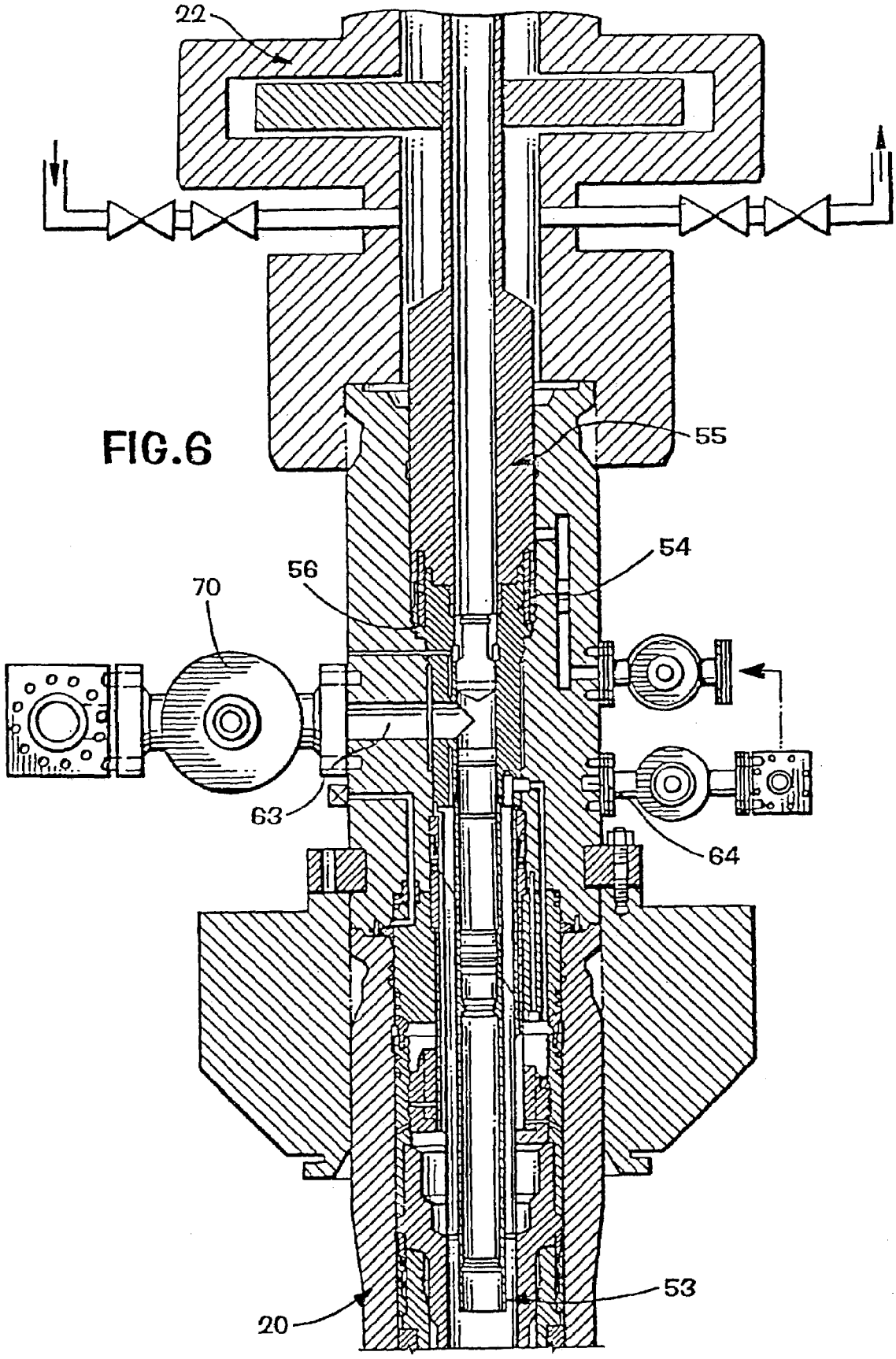
Figure 6A:
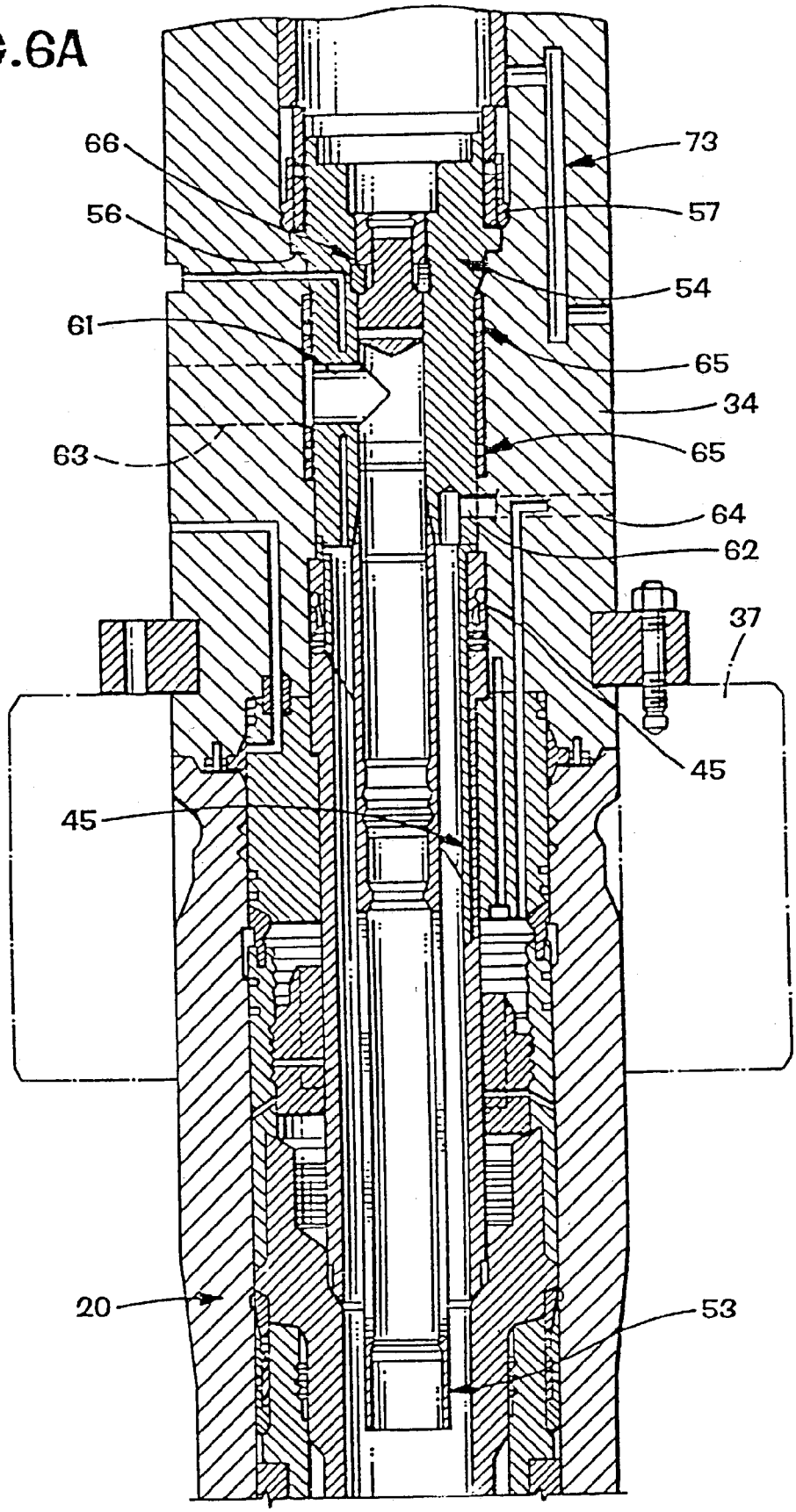

As shown in FIGS. 5, 6 and 6A a tubing string of production tubing 53 on a tubing hanger 54 is run in through the BOP 22 and spool tree 34 on a tool 55 until the tubing hanger lands by means of a keyed shoulder 56 on a landing in the spool tree and is locked down by a conventional mechanism 57. The tubing hanger 54 has a depending orientation sleeve 58 having an oblique lower edge forming a cam 59 which is complementary to the cam 50 in the sleeve 45 and, at the lower end of the cam, a downwardly projecting key 60 which is complementary to the key slot 51. The effect of the cams 50 and 59 is that, irrespective of the angular orientation of the tubing string as it is run in, the cams will cause the tubing hanger 54 to be rotated to its correct angular orientation relatively to the spool tree and the engagement of the key 60 in the key slot 51 will lock this relative orientation between the tubing hanger and spool tree, so that lateral production and tubing annulus fluid flow ports 61 and 62 in the tubing hanger 54 are in alignment with respective lateral production and tubing annulus fluid flow ports 63 and 64 through the wall of the spool tree. Metal to metal annulus seals 65, which are set by the weight of the tubing string, provide production fluid seals between the tubing hanger 54 and the spool tree 34. Provision is made in the top of the tubing hanger 54 for a wireline set plug 66. The keyed shoulder 56 of the tubing hanger lands in a complementary machined step in the spool tree 34 to ensure ultimate machined accuracy of orientation between the tubing hanger 54 and the spool tree 34.

Figure 7:
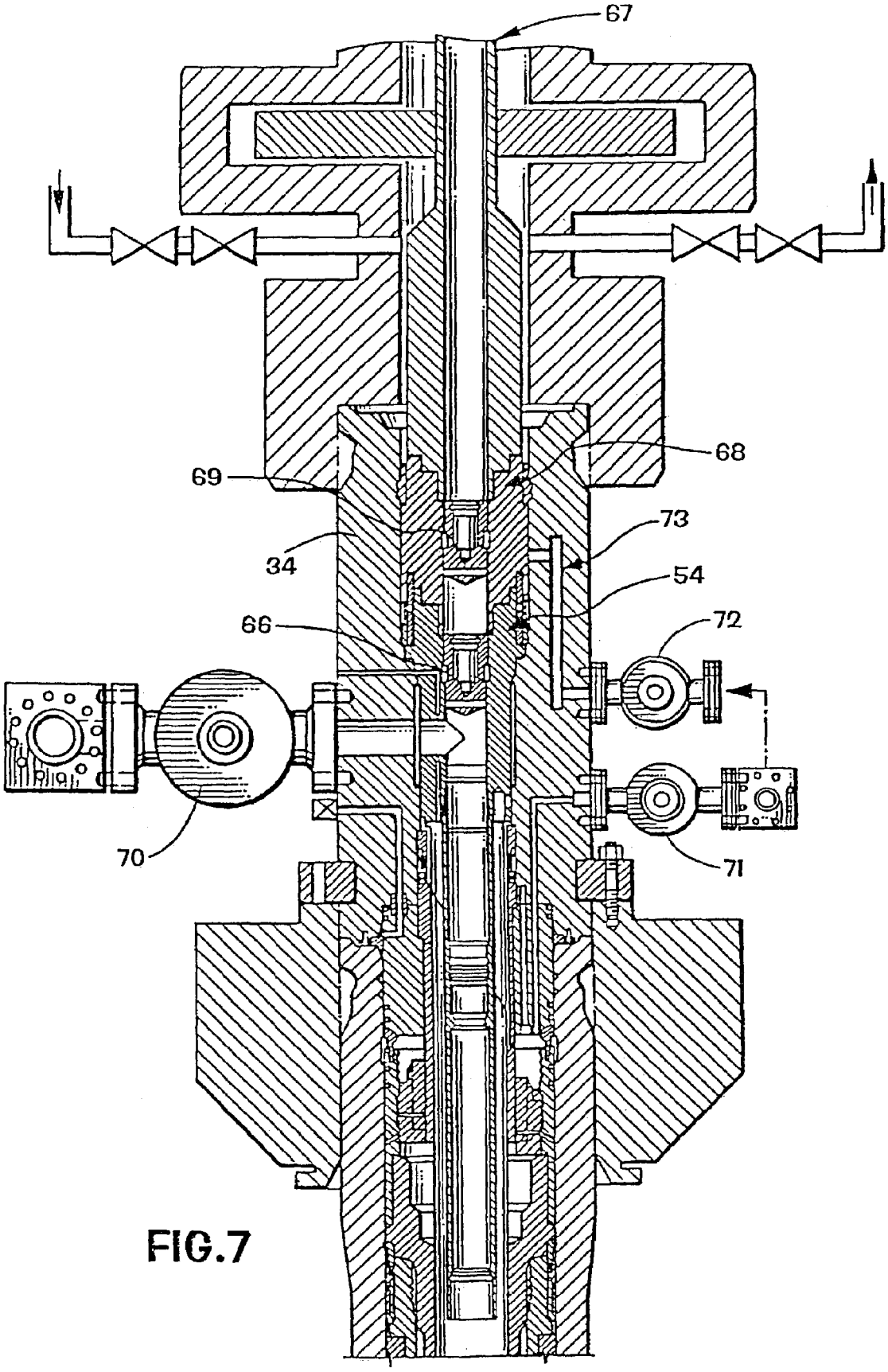

FIG. 7 shows the final step in the completion of the spool tree. This involves the running down on drill pipe 67 through the BOP, an internal isolation stopper 68 which seals within the top of the spool tree 34 and has an opening closed by an in situ wireline activated plug 69. The BOP can then be removed leaving the wellhead in production mode with double barrier isolation at the upper end of the spool tree provided by the plugs 66 and 69 and the stopper 68. The production fluid outlet is controlled by a master control valve 70 and pressure through the tubing annulus outlet ports 62 and 64 is controlled by an annulus master valve 71. The other side of this valve is connected, through a workover valve 72 to a lateral workover port 73 which extends through the wall of the spool tree to the void between the plugs 69 and 66. With this arrangement, wireline access to the tubing annulus in and downstream of a tubing hanger is unnecessary as any circulation of fluids can take place through the valves 71 and 72, the ports 62, 64 and 73, and the kill or choke lines of any BOP which has been installed. The spool tree in the completed production mode is shown in FIG. 8.

Figure 9:
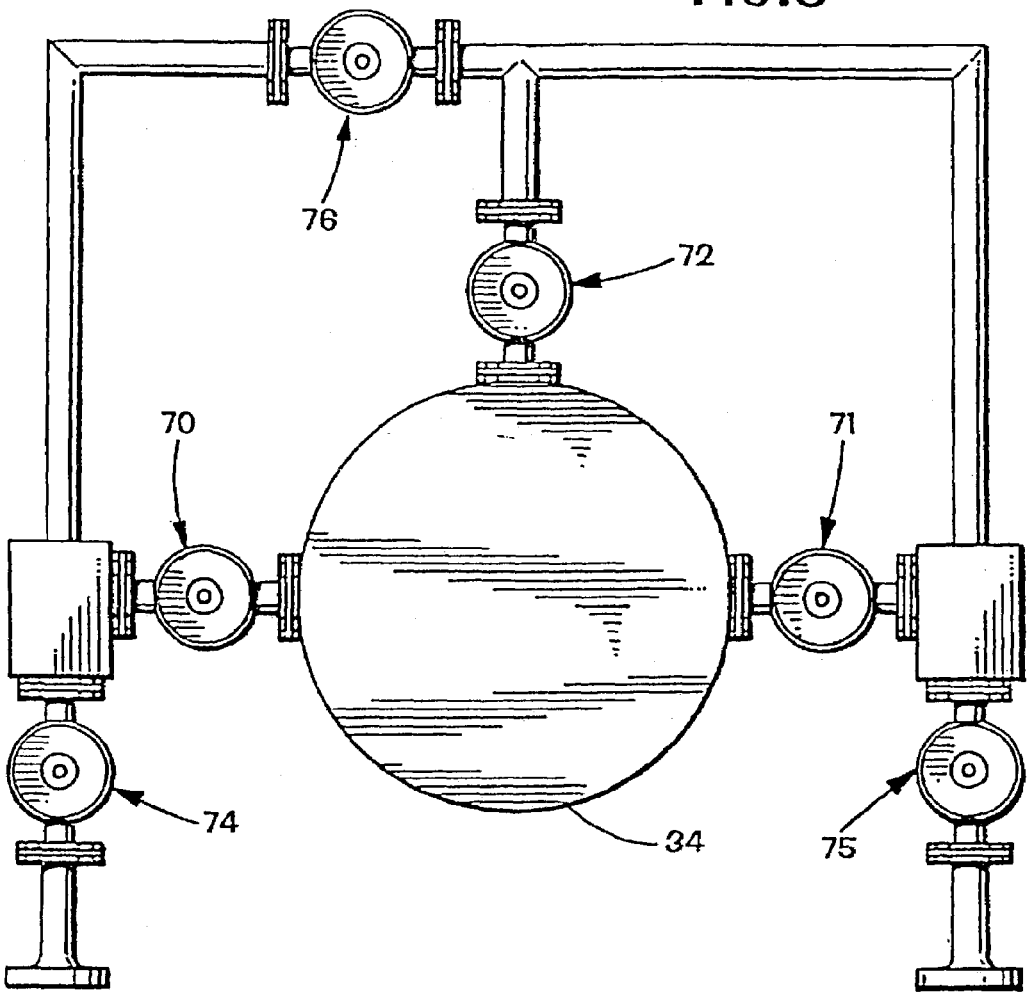
FIG. 9 is a circuit diagram showing external connections to the spool 3.

FIG. 9 shows valve circuitry associated with the completion and, in addition to the earlier views, shows a production fluid isolation valve 74, a tubing annulus valve 75 and a cross over valve 76. With this arrangement a wide variety of circulation can be achieved down hole using the production bore and tubing annulus, in conjunction with choke and kill lines extending from the BOP and through the usual riser string. All the valves are fail/safe closed if not actuated.

The arrangement shown in FIGS. 1 to 9 is a mono production bore wellhead which can be accessed by a single wireline or drill pipe, and the external loop from the tubing annulus port to the void between the two plugs at the top of the spools tree avoids the need for wireline access to the tubing annulus bore.

Figure 8:
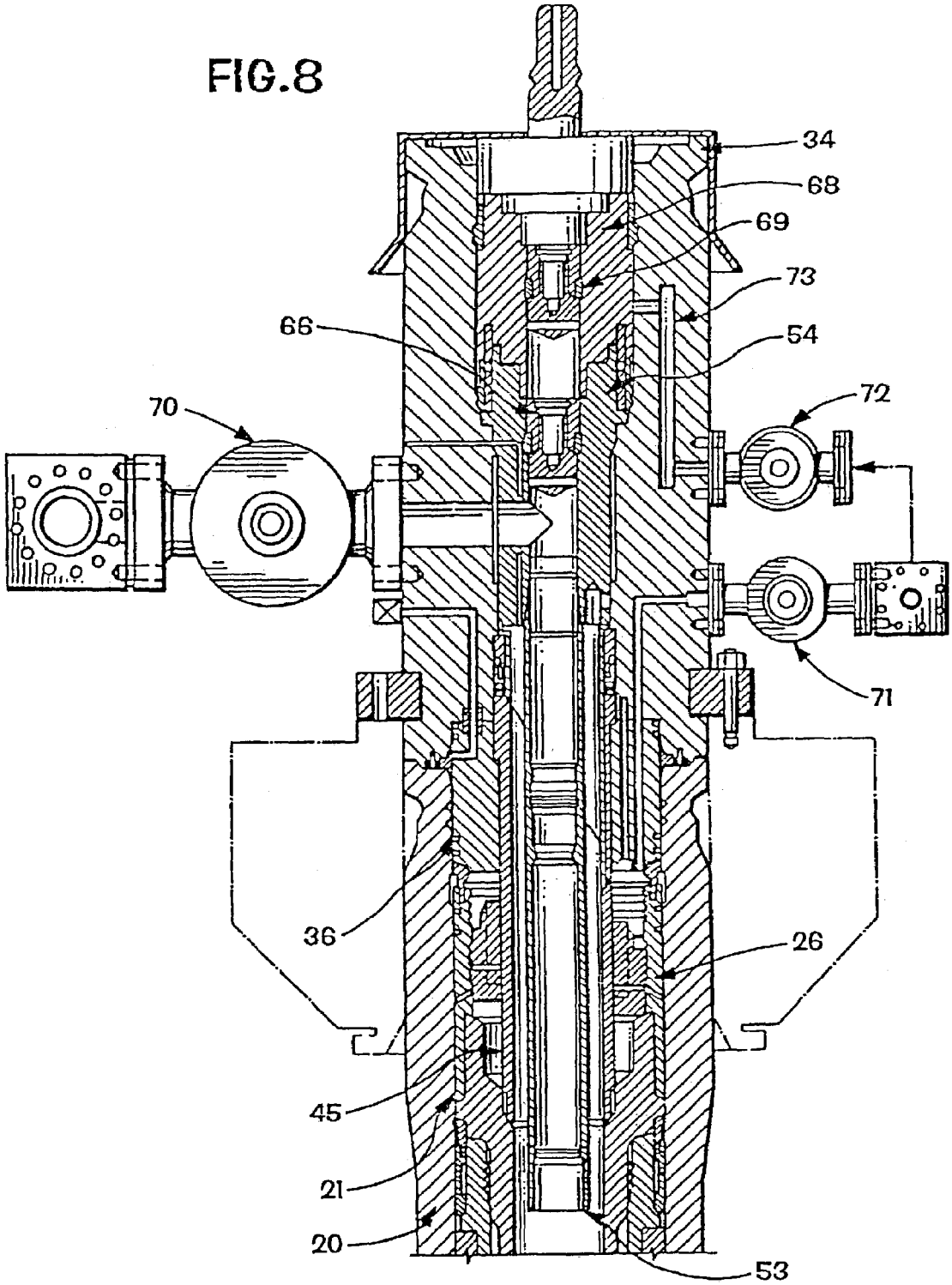
Figure 10:
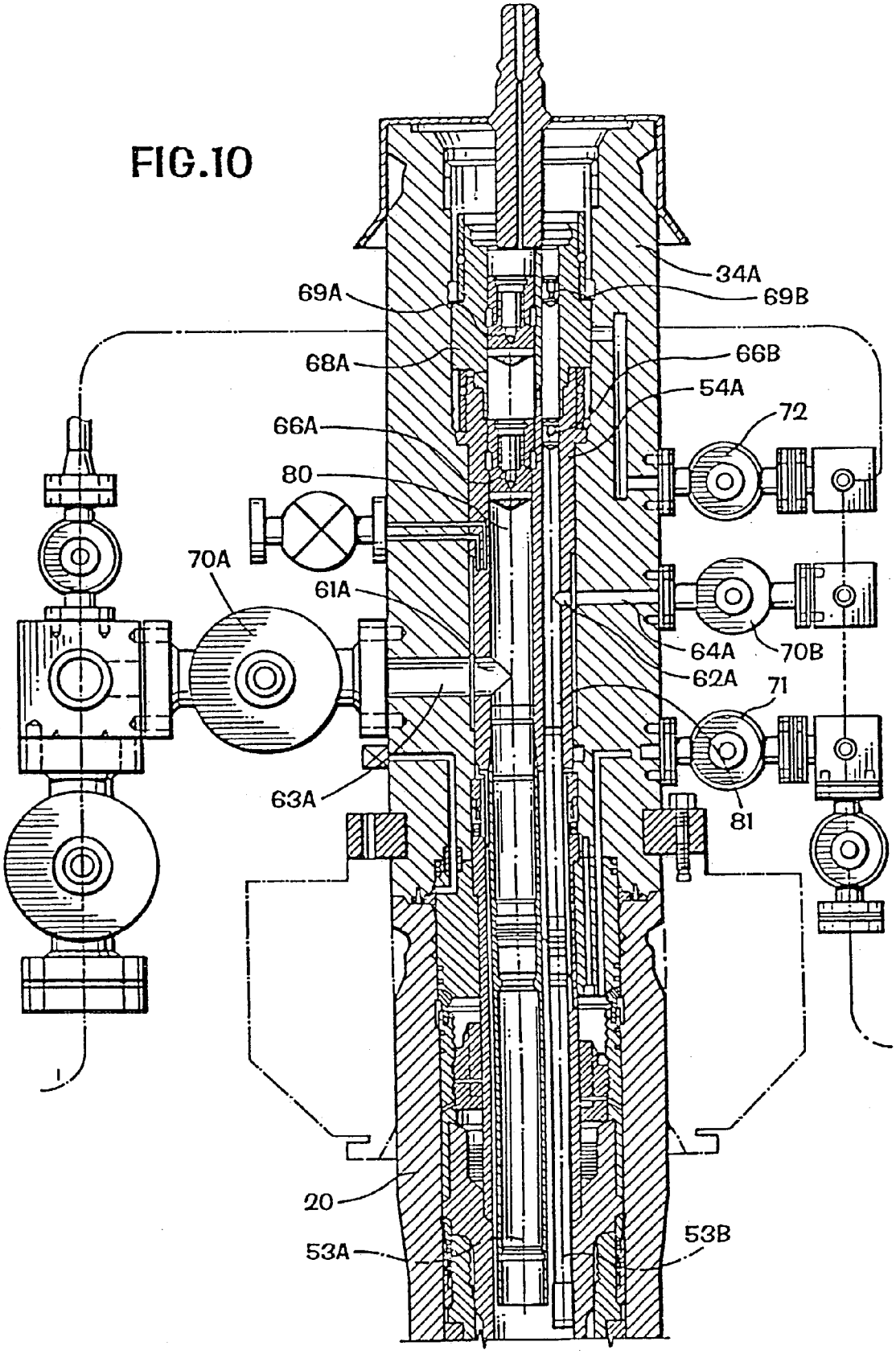
FIG. 10 is a vertical axial section through a completed dual production bore well in production mode.

FIG. 10 corresponds to FIG. 8 but shows a 5-½ inch×2-⅜ inch dual production bore wellhead with primary and secondary production tubing 53A and 53B. Development and completion are carried out as with the monobore wellhead except that the spool tree 34A and tubing hanger 54A are elongated to accommodate lateral outlet ports 61A, 63A for the primary production fluid flow from a primary bore 80 in the tubing hanger to a primary production master valve 70A, and lateral outlet ports 62A, 64A for the secondary production fluid flow from a secondary bore 81 in the tubing hanger to a secondary production master valve 70B. The upper ends of the bores 80 and 81 are closed by wireline plugs 66A and 66B. A stopper 68A, which closes the upper end of the spool tree 34A has openings, in alignment with the plugs 66A and 66B, closed by wireline plugs 69A and 69B.

Figure 13:
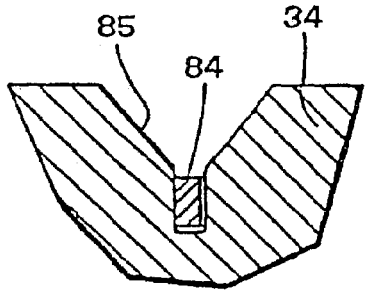
Figure 13A:
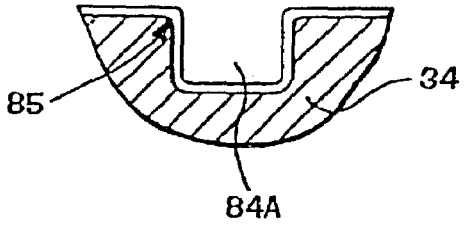
Figure 13B:
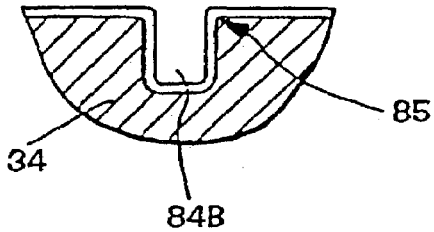
Figure 11:
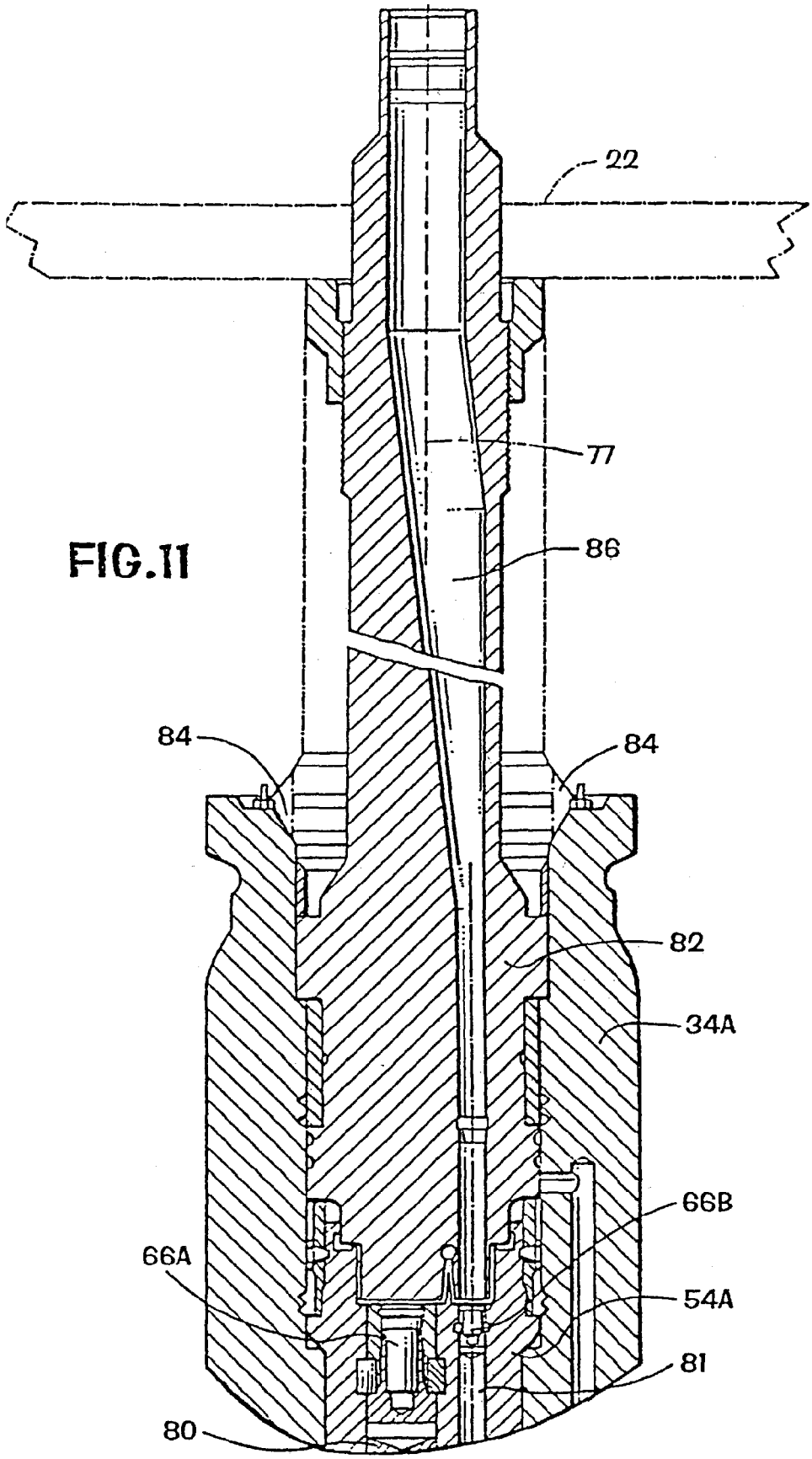
FIGS. 11 and 12 are vertical axial sections showing alternative connectors to the upper end of the dual production bore wellhead during work over; and, FIG. 13 is a detail showing the seating of one of the connectors in the spool tree.
Figure 12:
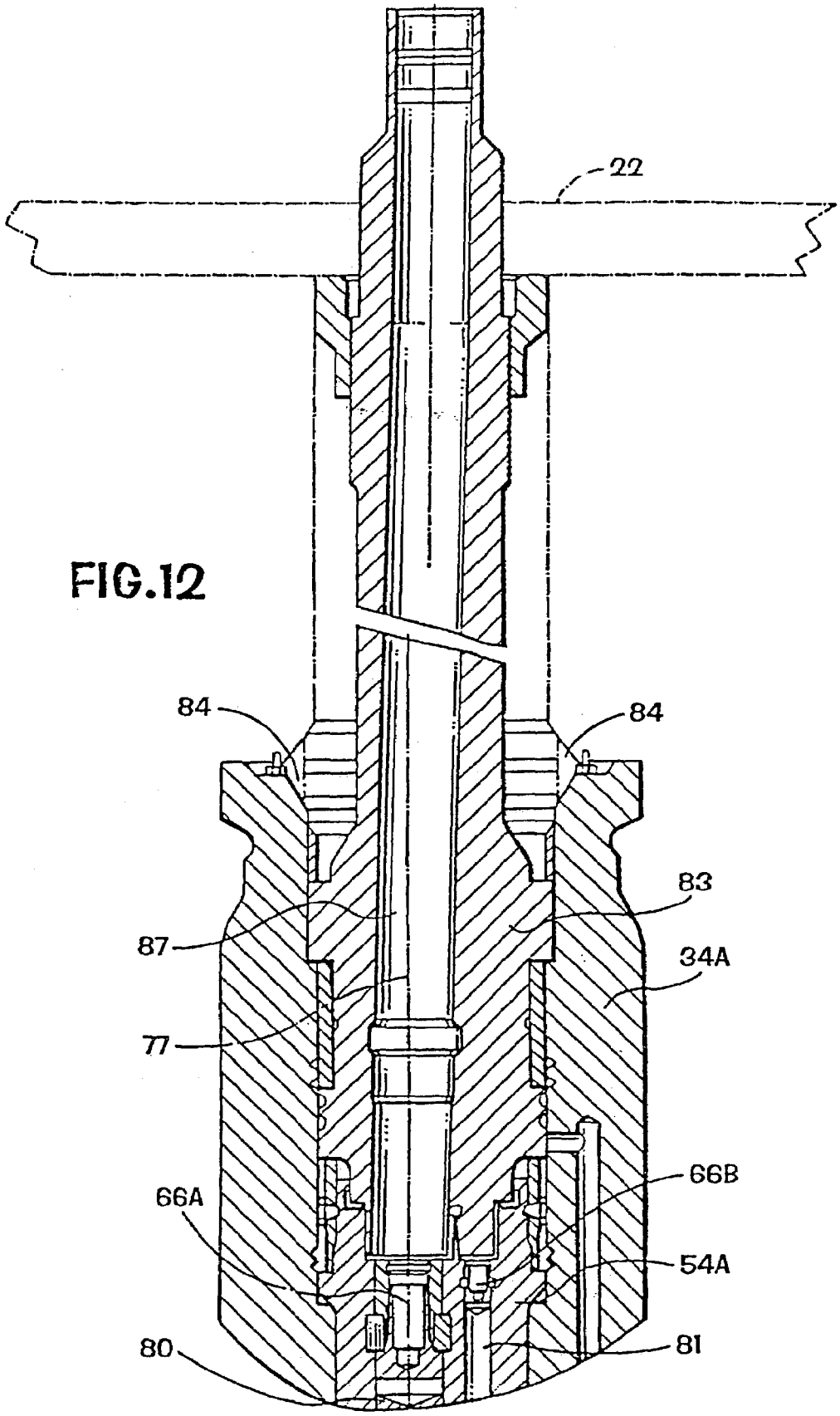

FIGS. 11 and 12 show how a wireline 77 can be applied through a single drill pipe to activate selectively one or other of the two wireline plugs 66A and 66B in the production bores 80 and 81 respectively. This involves the use of a selected one of two connectors 82 and 83. In practice, a drilling BOP 22 is installed and the stopper 68A is removed. Thereafter the connector 82 or 83 is run in on the drill pipe or tubing until it lands in, and is secured and sealed to the spool tree 34A. FIG. 13 shows how the correct angular orientation between the connector 82 or 83 and the spool tree 34A, is achieved by wing keys 84, which are guided by Y-shaped slots 85 in the upper inner edge of the spool tree, first to bring the connectors into the right angular orientation, and then to allow the relative axial movement between the parts to enable the stabbing function when the wireline connector engages with its respective pockets above plug 66A or 66B. To ensure equal landing forces and concentricity on initial contact, two keys 84A and 84B are recommended. As the running tool is slowly rotated under a new control weight, it is essential that the tool only enters in one fixed orientation. To ensure this key 84A is wider than key 84B and its respective Y-shaped slots. It will be seen that one of the connectors 82 has a guide duct 86 which leads the wireline to the plug 66B whereas the other connector 83 has a similar guide duct 87 which leads the wireline to the other plug 66A.

The invention claimed is:

1. An assembly for supporting tubing within a well having a wellhead housing and for selective use with a blowout preventer having a BOP bore comprising:

a subsea tree adapted for disposal below the blowout preventer and fixed and sealed to the wellhead housing, said subsea tree having a wall with a central bore therethrough and a first lateral port connected to a valve, said central bore having an internal surface and adapted to form a common passageway with the BOP bore;

a tubing hanger landed and sealed within said subsea tree at a predetermined angular position at which a second lateral port in said tubing hanger is in alignment with said first lateral port in said subsea tree, said tubing hanger supporting the tubing;

at least one vertical bore in said tubing hanger being sealed above said second lateral port by a sealing member, and said internal surface of said central bore through said subsea tree being sealed above said tubing hanger by an internal tree cap, said sealing member and internal tree cap being retrievable through the BOP bore;

a workover port extending through said wall of said subsea tree for selective fluid circulation with that portion of said common passageway below the BOP bore and above said tubing hanger; and an annulus port extending through said wall of said subsea tree for selective fluid circulation with an annulus around the tubing, said workover and annulus ports being interconnected via a flow passageway having at least one valve.

2. The assembly of claim 1 wherein said internal tree cap includes an opening therethrough.

3. The assembly of claim 2 further includes means for opening and closing said opening.

4. The assembly of claim 3 wherein said means for opening and closing includes a plug.

5. The assembly of claim 3 wherein a circulation flow path is formed through said internal tree cap opening and said workover port for selective fluid circulation during workover.

6. The assembly of claim 1 wherein said internal tree cap is removable.

7. The assembly of claim 1 wherein said internal tree cap is a plug.

8. The assembly of claim 7 wherein said plug is an internal isolation stopper.

9. The assembly of claim 8 wherein said plug includes an opening.

10. The assembly of claim 9 wherein said opening is closed by an in situ wireline activated plug.

11. The assembly of claim 3 wherein said means for opening and closing is not a valve having a flow bore therethrough which is substantially the same size as the central bore through said subsea tree.

12. The assembly of claim 1 further including a production fluid flow passage, said production fluid flow passage extending through the tubing, through that tubing hanger portion of said at least one vertical bore of said tubing hanger below said sealing member, through said second lateral port, and through said first lateral port, said production fluid flow passage not including any internal valves.

13. The wellhead assembly of claim 1 further comprising a bypass flowpath extending from said annulus port, through said flow passageway and said workover port, to said central bore above said tubing hanger.

14. The wellhead assembly of claim 1, further comprising a crossover flowpath interconnecting said first lateral port and said flow passageway, said crossover flowpath having a crossover valve for controlling flow therethrough.

15. The wellhead assembly of claim 14 further comprising a first combined workover flowpath extending from said annulus port, through said flow passageway and said crossover flowpath, to said first lateral port.

16. The wellhead assembly of claim 14 further comprising a second combined workover flowpath extending from said workover port, through said flow passageway and said crossover flowpath, to said first lateral port.

17. The wellhead assembly of claim 1 wherein said central bore has an inside diameter substantially the same as the diameter of the BOP bore.

18. An assembly for supporting tubing within a well from a wellhead housing for selective use with a blowout preventer having a BOP bore comprising:

a subsea tree adapted for disposal below the blowout preventer and fixed and sealed to the wellhead housing, said subsea tree having a wall with a central bore therethrough and a first lateral port connected to a valve, said central bore having an internal surface and adapted to form a common passageway with the BOP bore;

a tubing hanger landed and sealed within said subsea tree at a predetermined angular position at which a second lateral port in said tubing hanger is in alignment with said first lateral port in said subsea tree, said tubing hanger supporting the tubing;

at least one vertical bore in said tubing hanger;

a workover port extending through said wall of said subsea tree for selective fluid circulation with that portion of said common passageway below the BOP bore and above said tubing hanger; and an annulus port extending through said wall of said subsea tree for selective fluid circulation with an annulus around the tubing, said workover and annulus ports being interconnected via a flow passageway having at least one valve; and further including a casing annulus passageway having an internal valve.

19. An assembly for supporting tubing within a well from a wellhead housing for selective use with a blowout preventer having a BOP bore comprising:

a subsea tree adapted for disposal below the blowout preventer and fixed and sealed to the wellhead housing said subsea tree having a wall with a central bore therethrough and a first lateral port connected to a valve, said central bore having an internal surface and adapted to form a common passageway with the BOP bore;

a tubing hanger landed and sealed within said subsea tube at a predetermined angular position at which a second lateral port in said tubing hanger is in alignment with said first lateral port in said subsea tree, said tubing hanger supporting the tubing;

at least one vertical bore in said tubing hanger;

a workover plot extending through said wall of said subsea tree for selective fluid circulation with that portion of said common passageway below the BOP bore and above said tubing hanger; and an annulus port extending through said wall of said subsea tree for selective fluid circulation with an annulus around the tubing, said workover and annulus ports being interconnected via a flow passageway having at least one valve; and further including a running tool supporting an internal tree cap, said internal tree cap having an opening therethrough and being received by said central bore above said tubing hanger.

20. The assembly of claim 19 wherein a circulation flowpath is formed through said running tool, said opening, said tubing hanger and the tubing for selective circulation downhole.

21. The assembly of claim 19 wherein said opening may opened and closed remotely.

22. The assembly of claim 19 further including a sealing member having seals therearound to sealingly engage said internal surface of said central bore through said subsea tree to seal said central bore above said tubing hanger.

23. The assembly of claim 22 wherein said sealing member has an aperture therethrough.

24. The assembly of claim 22 wherein said sealing member is removable through the BOP bore.

25. An assembly for supporting pipe in a well and for selective use with a blowout preventer having a BOP bore, the assembly for use with a subsea wellhead, the assembly comprising:

a mandrel adapted to be disposed below the blowout preventer and fixed and sealed to the wellhead said mandrel having a mandrel bore therethrough forming a mandrel wall with a mandrel lateral production passageway extending through said wall;

a hanger having a hanger bore and a hanger lateral production passageway, the hanger being landed within said mandrel bore with said hanger lateral production passageway being in flow communication with said mandrel lateral production passageway said hanger supporting the pipe and forming a pipe annulus;

hanger seals sealing between said mandrel wall and said hanger to form an upper mandrel bore portion, said upper mandrel bore portion being adapted to form a common passageway with the BOP bore said hanger seals sealing off said mandrel and hanger lateral production passageways from said common passageway;

a passageway in said mandrel wall extending from the pipe annulus to an opening in said mandrel wall;

an aperture in said mandrel wall to said upper mandrel bore portion; and a circulation path extending from said opening in said mandrel wall to said aperture in said mandrel wall to said upper mandrel bore portion, said circulation path allowing selective fluid circulation between said pipe annulus and said common passageway;

a first plug removable through the BOP bore and received by said hanger bore to seal said hanger bore above said hanger lateral production passageway; and further including a second plug removable through the BOP bore and received by said mandrel bore to seal said upper mandrel bore portion above said hanger seals.

26. The assembly of claim 25 wherein said first plug and said second plug are passable through the BOP bore.

27. The assembly of claim 25 said second plug includes external seals that sealingly engage said mandrel wall.

28. An assembly for supporting tubing within a well from a subsea wellhead for selective use with a blowout preventer having a BOP bore, the assembly comprising:

a mandrel adapted to be disposed below the blowout preventer and fixed and sealed to the wellhead, said mandrel having a mandrel vertical bore therethrough forming a mandrel wall with a mandrel lateral production passageway extending through said wall, said mandrel bore having an internal surface;

a tubing hanger having a hanger vertical bore and a hanger lateral production passageway, the hanger being landed within said mandrel vertical bore with said hanger lateral production passageway being in flow communication with said mandrel lateral production passageway, said hanger supporting the tubing forming a tubing annulus;

hanger seals sealing between said mandrel wall and said hanger to form a mandrel non-production flow bore above said hanger seals, said mandrel non-production flow bore being adapted to form a common passageway with the BOP bore, said hanger seals sealing off said mandrel and hanger lateral production passageways from said mandrel non-production flow bore and the common passageway;

a passageway in said mandrel wall extending from the pipe annulus to an opening in said mandrel wall below said hanger seals;

an aperture in said mandrel wall above said hanger seals to said mandrel non-production flow bore;

a circulation passageway extending from said opening in said mandrel wall below said hanger seals to said aperture in said mandrel wall above said hanger seals to said mandrel non-production flow bore, said circulation passageway allowing selective fluid circulation between said pipe annulus and said mandrel non-production flow bore and the common passageway;

a first plug removable through the BOP bore and sealing said hanger vertical bore above said hanger lateral production bore; and a second plug removable through the BOP bore and sealing said mandrel non-production flow bore above said tubing hanger.

29. An apparatus for use selectively with a blowout preventer for controlling the flow of fluids in a well comprising:

a subsea tree adapted for disposal below the blowout preventer, said subsea tree having a central bore formed by a wall of said subsea tree and a production passageway, an annulus passageway, and a workover passageway in said wall, said workover passageway extending laterally into said central bore;

a production valve disposed with said subsea tree for controlling flow through said production passageway;

an annulus valve disposed with said subsea tree for selective fluid circulation downhole through said annulus passageway;

a workover valve disposed with said subsea tree for selective fluid circulation through said workover passageway;

a tubing hanger supported and sealed within said subsea tree and suspending tubing in the well, said tubing hanger and tubing having a flowbore and forming an annulus in the well, said tubing hanger having an aperture communicating said flowbore with said production passageway, and said annulus passageway communicating with said annulus;

said workover passageway in fluid communication with said subsea tree central bore above said tubing hanger;

said annulus passageway in fluid communication with said workover passageway;

said production passageway in fluid communication with said annulus passageway and workover passageway;

a crossover valve for controlling fluid flow between said production passageway and said annulus passageway or workover passageway; and fluid circulation paths being formed between said subsea tree central bore, workover passageway, and annulus passageway to selectively circulate downhole using said tubing flowbore and tubing annulus.

30. The apparatus of claim 29 further including a production fluid isolation valve communicating with said production passageway and an annulus isolation valve communicating with said annulus passageway.

31. A method for controlling fluid flow in a well comprising:

suspending tubing from a tubing hanger;

supporting and sealing the tubing hanger within the bore of a subsea tree for selective disposal below a blowout preventer having a BOP bore;

forming a common flow passageway between the BOP bore and a portion of the subsea tree bore above the seals around the tubing hanger;

extending a tubular member into the BOP bore, attaching the tubular member to the tubing hanger, and closing the blowout preventer therearound;

forming a flowpath through the tubing and the tubular member, forming an annular area between the tubular member and the subsea tree in the common flow passageway and forming an annulus around the tubing below the tubing hanger;

forming a production passageway through the tubing, through a lateral port in the tubing hanger and through the wall of the subsea tree;

controlling flow through the production passageway by a production valve;

forming an annulus passageway from the annulus and through the wall of the subsea tree;

controlling flow through the annulus passageway by an annulus valve;

forming a workover passageway from the annular area between the tubular member and subsea tree and through the wall of the subsea tree;

controlling flow through the workover passageway;

providing fluid communication between the workover passageway and the annulus passageway;

forming a crossover fluid passageway between the production passageway and annulus passageway;

controlling flow through the crossover fluid passageway; and circulating fluid downhole using the flowpath, tubing annulus, annulus passageway, workover passageway, and annular area.

32. The method of claim 31 further including flowing fluid downhole through the workover passageway, the crossover passageway, and the production passageway.

33. A method for controlling fluid flow in a well comprising:

suspending tubing from a tubing hanger;

supporting and sealing the tubing hanger within the bore of a subsea tree for selective disposal below a blowout preventer having a BOP bore;

forming a common flow passageway between the BOP bore and a portion of the subsea tree bore above the tubing hanger;

forming a flowbore through the tubing and an annulus around the tubing below the tubing hanger;

forming a production passageway from the flowbore, through a lateral port in the tubing hanger and through the wall of the subsea tree;

controlling flow through the production passageway by a production valve;

forming an annulus passageway from the annulus and through the wall of the subsea tree;

controlling flow through the annulus passageway by an annulus valve;

installing a tubing hanger closure member in the tubing hanger above the production passageway;

installing an internal tree cap within the portion of the subsea tree bore above the tubing hanger;

forming a workover passageway through the wall of the subsea tree from the bore of the subsea tree above the tubing hanger and between the tubing hanger sealing member and internal tree cap;

controlling flow through the workover passageway;

forming a crossover fluid passageway between the production passageway and annulus passageway;

controlling flow through the crossover fluid passageway;

providing fluid communication between the workover passageway and the crossover fluid passageway; and flowing fluid through the production passageway, through the crossover passageway and into the workover passageway between the tubing hanger sealing member and the internal tree cap.

34. An assembly for use selectively with a blowout preventer for operating a subsea well, comprising:

a subsea tree adapted for disposal below the blowout preventer and having a central bore therethrough, a portion of said central bore being formed by an internal generally vertical wall surface, said internal generally vertical wall surface having an opening therein;

a tubing hanger assembly mounted and sealed in a predetermined angular position within said central bore of said subsea tree and suspending tubing within the well, said tubing hanger assembly and tubing forming a central passageway therethrough and an annulus around the tubing below the tubing hanger;

a production passageway extending from said central passageway of said tubing hanger assembly into said wall of said subsea tree;

an annulus passageway extending from said annulus around the tubing below the tubing hanger and into said wall of said subsea tree;

a workover passageway extending from said opening in said central bore and into said subsea tree, said opening in fluid communication with said central bore above the tubing hanger; and said annulus passageway and workover passageway being in fluid communication through a flowpath to selectively circulate downhole from said central bore of said subsea tree through said workover passageway and annulus passageway with flow through said tubing hanger assembly annulus and central passageway of said tubing hanger assembly.

35. The assembly of claim 34 further comprising an internal tree cap sealingly disposed within said central bore of said subsea tree to control flow through said central bore.

36. An assembly for use selectively with a blowout preventer having a BOP bore for operating a subsea well, comprising:

a subsea tree adapted for disposal below the blowout preventer and having a generally cylindrical wall forming a central bore therethrough, a portion of said central bore being adapted to form a flow passageway with the BOP bore;

a tubing hanger assembly mounted and sealed within said central bore of said subsea tree and suspending tubing within the well, said tubing hanger and tubing forming a central passageway in fluid communication with said central bore of said subsea tree above said tubing hanger assembly and forming an annulus around the tubing below the tubing hanger;

a production passageway extending from said central passageway of said tubing hanger assembly into said wall of said subsea tree;

an annulus passageway extending from said annulus around the tubing below the tubing hanger and into said wall of said subsea tree;

a workover passageway extending from said portion of said central bore of said subsea tree and into said subsea tree wall for fluid communication with said portion of said subsea tree central bore above said tubing hanger;

said annulus passageway and workover passageway being in fluid communication through a flowpath outside of said central bore of said subsea tree;

a sealing member mounted within said central passageway of said tubing hanger assembly to control flow through said central passageway and through said central bore of said subsea tree; and a sealing member sealed and locked internally of said portion of said central bore above said tubing hanger assembly.

37. A wellhead assembly for supporting tubing in a well having a wellhead and for use selectively with a blowout preventer having a BOP bore, the wellhead assembly comprising:

a subsea tree adapted for disposal below the blowout preventer and fixed and sealed to the wellhead housing, said subsea tree having a wall with a central bore therethrough and at least a first lateral production fluid outlet port connected to a valve, a portion of said central bore being adapted to form a common passageway with the BOP bore;

a tubing hanger supporting the tubing and landed and sealed within said subsea tree at a predetermined angular position at which a second lateral production fluid outlet port in said tubing hanger is in alignment with said first lateral production fluid outlet port in said subsea;

at least one vertical production fluid bore in said tubing hanger being sealed above said second lateral production fluid outlet port by a sealing member, and said portion of said central bore through said subsea tree being internally sealed above said tubing hanger by an internal tree cap removable through the BOP bore;

a workover port extending at least partially through said wall of said subsea tree from an area in said portion of said central bore between said sealing member and internal tree cap; and a tubing annulus fluid port extending at least partially through said wall of said subsea tree from an annulus formed around the tubing; said workover and tubing annulus ports in said subsea tree being interconnected via a passageway having at least one valve.

38. A tree system for use selectively with a blowout preventer having a BOP bore for a subsea well, comprising:

a subsea tree having a bore therethrough, a portion of said bore being adapted to form a flow passageway with the BOP bore upon installing the blowout preventer above said subsea tree;

a tubing hanger suspending tubing and supported by said subsea tree, seals sealing between said tubing hanger and said subsea tree, said tubing hanger and tubing having an internal production bore extending downwardly into the well and forming a tubing annulus extending downwardly into the well;

said subsea tree and tubing hanger forming a lateral production flowpath in fluid communication with said internal production bore and having a production control valve for opening and closing said lateral production flowpath to control flow therethrough;

said subsea tree forming an annulus flowpath in fluid communication with said tubing annulus and having an annulus control valve controlling flow therethrough;

said subsea tree having a workover flowpath through the wall of the subsea tree communicating with said portion of said subsea tree bore above said seals and having a workover valve controlling flow therethrough;

a circulation flowpath being formed through said internal production bore of said tubing hanger with said lateral production flowpath closed and through said tubing annulus to selectively circulate fluid downhole using said internal production bore and said tubing annulus; and said internal production bore above said lateral production flowpath being adapted for isolation from said subsea tree bore portion.

39. The tree system of claim 38, further comprising:

a sealing member mounted in said tubing hanger; and, an internal tree cap sealably mounted completely internal of said portion of said bore of said subsea tree.

40. The tree system of claim 39, wherein a fluid passageway is formed above said sealing member for selective fluid circulation.

41. The tree system of claim 39, further including a first external flowpath with a tubing annulus valve for controlling flow therethrough, a second external flowpath with a production fluid isolation valve for controlling flow therethrough, and a fluid passageway formed between said first and second external flowpaths by said annulus flowpath, tubing annulus, production bore, and production flowpath.

42. A tree system for a subsea well having a wellhead and for use selectively with a blowout preventer having a BOP bore with a tubular member extending through the BOP bore and having a fluid bore, comprising:

a subsea tree for installation on the wellhead, said subsea tree having a wall with a bore therethrough, a portion of said bore being adapted to form a flow passageway with the BOP bore upon installation of the blowout preventer above said subsea tree;

a tubing hanger suspending tubing and supported by said subsea tree, seals sealing between said tubing hanger and said subsea tree, said tubing hanger and tubing having an internal production bore and forming a tubing annulus extending downwardly into the well, said internal production bore adapted for connection with the tubular member for fluid communication with the fluid bore of the tubular member;

said subsea tree and tubing hanger forming a lateral production flowpath in fluid communication with said internal production bore and having a production control valve controlling flow therethrough;

said subsea tree forming an annulus flowpath in fluid communication with said tubing annulus and having an annulus control valve controlling flow therethrough;

said subsea tree having a workover flowpath through the wall of the subsea tree communicating with said portion of said subsea tree bore above said seals and having a workover valve controlling flow therethrough;

a circulation flowpath being formed upon establishing fluid communication between said internal production bore of said tubing hanger and tubing and fluid bore of said tubular member, said circulation flowpath allowing flow through said internal production bore of said tubing hanger and tubing and fluid bore of said tubular member and through said annulus and annulus flowpath for selective fluid circulation through said circulation flowpath;

a workover/annulus flow connection interconnecting said workover flowpath and said annulus flowpath for selective fluid circulation downhole through said circulation flowpath and said workover flowpath to an annular area formed between the tubular member and subsea tree bore.

43. The tree system of claim 42 further comprising a bypass flowpath extending from said annulus flowpath, through said workover/annulus flow connection and said workover flowpath, to said portion of said subsea tree bore.

44. The tree system of claim 42, further comprising a crossover flowpath interconnecting said production flowpath and said workover/annulus flow connection, said crossover flowpath having a crossover valve for controlling flow therethrough.

45. The tree system of claim 44 further comprising a first combined workover flowpath extending from said annulus flowpath, through said workover/annulus flow connection and said crossover flowpath, to said production flowpath.

46. The tree system of claim 44 further comprising a second combined workover flowpath extending from said workover flowpath, through said workover/annulus flow connection and said crossover flowpath, to said production flowpath.

47. A tree system for a wellhead for the completion and work-over of a subsea well from the sea surface, comprising:

a subsea tree having a bore and for installation on the wellhead;

a tubing hanger suspending tubing and supported by said subsea tree, seals sealing between said tubing hanger and said subsea tree, said tubing having an internal production bore and forming a tubing annulus extending downwardly into the well;

said subsea tree and tubing hanger forming a production flowpath in fluid communication with said internal production bore and having a production control valve controlling flow therethrough;

said subsea tree forming an annulus flowpath in fluid communication with said tubing annulus and having an annulus control valve controlling flow therethrough;

a blowout preventer having a BOP bore and a member for closing said BOP bore, a portion of said subsea tree bore adapted to form a flow passageway with said BOP bore;

said subsea tree having a workover flowpath communicating with said subsea tree bore portion above said seals and below said BOP bore and having a workover valve controlling flow therethrough;

choke and kill lines connected to said blowout preventer for communicating said BOP bore with the surface; and a tubular member extending to the surface and in fluid communication with said tubing hanger, said tubular member forming a common bore communicating with said internal production bore for selective fluid circulation downhole using said internal production bore and tubing annulus in conjunction with at least one of said choke and kill lines extending from the BOP to the surface.

48. The tree system of claim 47, wherein one of said choke and kill lines forms a passageway from the surface to said BOP bore above said tubing hanger.

49. The tree system of claim 47 further comprising a workover/annulus flow path for fluid communication between said workover flowpath and said annulus flowpath for selective fluid communication.

50. The tree system of claim 47, further comprising a crossover flowpath interconnecting said production flowpath and said annulus flowpath, said crossover flowpath having a crossover valve for controlling flow therethrough.

51. A tree system for a wellhead for the completion and work-over of a subsea well from the sea surface, comprising:

a subsea tree having a bore and for installation on the wellhead;

a tubing hanger suspending tubing and supported by said subsea tree, seals sealing between said tubing hanger and said subsea tree, said tubing having an internal production bore and forming a tubing annulus extending downwardly into the well;

said subsea tree and tubing hanger forming a production flowpath in fluid communication with said internal production bore and having a production control valve controlling flow therethrough;

said subsea tree forming an annulus flowpath in fluid communication with said tubing annulus and having an annulus control valve controlling flow therethrough;

a drilling blowout preventer having a BOP bore and a member for closing said BOP bore, a portion of said subsea tree bore adapted to form a flow passageway with said BOP bore;

said subsea tree having a workover flowpath communicating with said subsea tree bore portion above said seals and below said BOP bore and having a workover valve controlling flow therethrough;

choke and kill lines connected to said drilling blowout preventer for communicating said BOP bore with the surface;

a pipe string extending to the surface and in fluid communication with said tubing hanger, said pipe string forming a common bore communicating with said internal production bore;

said workover flowpath being in fluid communication with said annulus flowpath; and a plurality of fluid passageways to the surface being formed by said common bore, production bore, tubing annulus, annulus flowpath, workover flowpath, BOP bore, and one of said choke and kill lines.

52. A tree system for a wellhead for the completion and work-over of a subsea well, the tree system being adapted for connection to a drilling blowout preventer having a BOP bore and a member for closing the BOP bore, the drilling blowout preventer being connected to choke and kill lines extending from the BOP bore to the sea surface, the BOP bore receiving a pipe string having a pipe string flow bore extending to the sea surface and the member closing against the pipe string to form an annular bore, the tree system comprising:

a subsea tree having a bore and for installation on the wellhead;

a tubing hanger suspending tubing and supported by said subsea tree, seals sealing between said tubing hanger and said subsea tree, said tubing having an internal production bore and forming a tubing annulus extending downwardly into the well;

said subsea tree and tubing hanger forming a production flowpath in fluid communication with said internal production bore and having a production control valve controlling flow therethrough;

said subsea tree forming an annulus flowpath in fluid communication with said tubing annulus and having an annulus control valve controlling flow therethrough;

a portion of said subsea tree bore being adapted to form a flow passageway with the annular bore;

said subsea tree having a workover flowpath extending from said subsea tree bore portion above said seals and below said BOP bore to said tubing annulus and having a workover valve controlling flow therethrough;

said workover flowpath being in fluid communication with said annulus flowpath;

said tubing hanger being adapted for fluid communication with the pipe string flow bore whereby the pipe string flow bore communicates with said internal production bore;

a crossover flowpath interconnecting said production flowpath and said annulus flowpath, said crossover flowpath having a crossover valve for controlling flow therethrough; and said pipe string flow bore, internal production bore, tubing annulus, workover flowpath, flow passageway and one of the choke and kill lines being adapted for selective fluid circulation.

53. A tree system for a wellhead for the completion and work-over of a subsea well, the tree system being adapted for connection to a drilling blowout preventer having a BOP bore and a member for closing the BOP bore, the drilling blowout preventer being connected to choke and kill lines extending from the BOP bore to the sea surface, the BOP bore receiving a pipe string having a pipe string flow bore extending to the sea surface and the member closing against the pipe string to form an annular bore, the tree system comprising:

a subsea tree having a bore and for installation on the wellhead;

a tubing hanger suspending tubing and supported by said subsea tree, seals sealing between said tubing hanger and said subsea tree, said tubing having an internal production bore and forming a tubing annulus extending downwardly into the well;

said subsea tree and tubing hanger forming a production flowpath in fluid communication with said internal production bore and having a production control valve controlling flow therethrough;

said subsea tree forming an annulus flowpath in fluid communication with said tubing annulus and having an annulus control valve controlling flow therethrough;

a portion of said subsea tree bore being adapted to form a flow passageway with the annular bore;

said subsea tree having a workover flowpath extending from said subsea tree bore portion above said seals and below said BOP bore to said tubing annulus and having a workover valve controlling flow therethrough;

said workover flowpath being in fluid communication with said annulus flowpath;

said tubing hanger being adapted for fluid communication with the pipe string flow bore whereby the pipe string flow bore communicates with said internal production bore;

a crossover flowpath interconnecting said production flowpath and said annulus flowpath, said crossover flowpath having a crossover valve for controlling flow therethrough; and a fluid passageway being formed by one of said choke and kill lines, flow passageway, workover flowpath, tubing annulus, internal production bore, and pipe string flow bore.

54. A tree system for a wellhead for the completion and work-over of a subsea well, comprising:

a subsea tree having a bore and for installation on the wellhead;

a tubing hanger suspending tubing and supported by said subsea tree, seals sealing between said tubing hanger and said subsea tree, said tubing having an internal production bore and forming a tubing annulus extending downwardly into the well;

said subsea tree and tubing hanger forming a production flowpath in fluid communication with said internal production bore and having a production control valve controlling flow therethrough;

said subsea tree forming an annulus flowpath in fluid communication with said tubing annulus and having an annulus control valve controlling flow therethrough;

a drilling blowout preventer having a BOP bore and a member for closing said BOP bore, a portion of said subsea tree bore adapted to form a flow passageway with said BOP bore;

said subsea tree having a workover flowpath communicating with said subsea tree bore portion above said seals and below said BOP bore and having a workover valve controlling flow therethrough;

choke and kill lines connected to said drilling blowout preventer for communicating said BOP bore with the surface;

a pipe string extending to the surface and in fluid communication with said tubing hanger, said pipe string forming a common bore communicating with said internal production bore;

said workover flowpath being in fluid communication with said annulus flowpath; and said member being closed around said pipe string;

a fluid passageway extending from the surface to the BOP bore through one of said choke and kill lines, and another fluid passageway extending from the surface through said common bore, internal production bore, tubing annulus, annulus flowpath, and workover flowpath to the BOP bore, and the other of said choke and kill lines extending from the BOP bore to the surface.

55. An assembly for use selectively with a blowout preventer having a BOP bore for operating a subsea well, comprising:

a subsea body adapted for disposal below the blowout preventer and having a generally cylindrical internal wall forming a subsea body central bore therethrough, a portion of said central bore being adapted to form a flow passageway with the BOP bore;

a tubing hanger assembly mounted in said subsea body central bore and having a central passageway with a production passageway extending from said tubing hanger central passageway, an annulus being formed around said tubing hanger assembly;

tubing hanger assembly seals sealing between said cylindrical internal wall and said tubing hanger assembly;

said internal wall of said subsea body having a production port in fluid communication with said production passageway, an annulus port in fluid communication with said annulus, and a workover port extending laterally from an opening in said internal wall and in fluid communication with said portion of said subsea body central bore above said production passageway; and said annulus port and said workover port being in fluid communication externally of said subsea body central bore to form a circulation path to selectively circulate between the annulus and said portion of said central bore.

56. A wellhead system comprising:

a wellhead;

an inner casing suspended within said wellhead and forming a casing annulus with an outer casing;

a mandrel disposed on said wellhead and having a bore therethrough;

tubing insertable through said bore and suspended within said mandrel and said inner casing, said tubing having a flowbore and forming a tubing annulus with said inner casing;

a first valve on said mandrel for controlling flow through said tubing flowbore;

a second valve on said mandrel for controlling flow through said casing annulus;

a flow passageway from said casing annulus to said bore; and a valve member disposed in said flow passageway for controlling flow through said casing annulus.

57. An assembly for a subsea well, comprising:

a subsea tree having a generally cylindrical internal wall forming an internal bore therethrough and a production port extending laterally through said wall in communication with said internal bore, said internal wall including a landing arranged to support a tubing hanger, with said production port arranged in use to communicate with a lateral production fluid outlet port in the tubing hanger, said tubing hanger having seals for sealing said production port in use between the tubing hanger and the internal wall;

a workover port extending laterally from an opening in said internal wall above said production port said opening of said workover port in said internal wall being located in use above said seals;

a tubing annulus port extending from an opening in said subsea tree below said production port; and said tubing annulus port and workover port being arranged to be in fluid communication externally of said internal bore.

58. The assembly according to claim 57, wherein said internal wall includes a profile above said production port arranged to receive an internal tree cap.

59. The assembly according to claim 57, wherein said subsea tree includes a profile adjacent one end of said internal bore arranged to receive a closure cap.

60. The assembly according to claim 57, wherein said tubing annulus port and said workover port are in communication with said internal bore via an external loop line.

61. The assembly according to claim 57, wherein said internal wall includes a landing shoulder arranged to support an orientation member.

62. The assembly according to claim 57, further including a tubing hanger and production tubing, the tubing hanger having a production bore in communication with the production tubing, with said lateral production port extending from said tubing hanger production bore, said production tubing forming a tubing annulus therearound, and said tubing annulus port being in fluid communication with the production tubing annulus, whereby a flowpath is formed from said opening of said workover port, through said workover port and said tubing annulus port to said production tubing annulus.

63. The assembly according to claim 57, further including a blowout preventer having a BOP bore and a member for closing the BOP bore with said subsea tree arranged below the blowout preventer and a portion of said internal bore of said subsea tree being arranged to form a flow passageway with the BOP bore.

64. The assembly according to claim 63, wherein said subsea tree is arranged to receive a tool through the flow passageway for connection to the tubing hanger for flow communication to the surface.

65. The assembly according to claim 63, wherein the internal wall is arranged to form an annular area around the tool upon closing the BOP bore, allowing selective fluid circulation through the annular area.

66. The assembly according to claim 65, wherein the blowout preventer has choke and kill lines communicating the BOP bore with the surface;

a first flow path being arranged from the surface through tool, tubing hanger, and production tubing; and a second flow path being arranged through the production tubing annulus, tubing annulus port, workover port, annular area and the choke and kill lines to the surface.

67. The assembly according to claim 57, further comprising a wellhead housing; said subsea tree body being fixed and sealed to the housing and said internal bore communicating with at least said production port connected to a valve; and a tubing hanger landed within the subsea tree at a predetermined angular position at which a lateral production port in the tubing hanger is in alignment with the production port in the subsea tree; wherein at least one vertical production bore in the tubing hanger is sealed above the respective production port by a sealing member, and said workover port extends laterally through the wall of the subsea tree from above the sealing member.

68. The assembly according to claim 67, further including a further sealing member sealing the internal bore above the tubing hanger.

69. The assembly according to claim 68 wherein the sealing member is a wireline plug and the further sealing member is a stopper which contains at least one opening closed by a wireline plug.

70. The assembly according to claim 69 wherein the workover port extends laterally through the wall of the subsea tree between the sealing members.

71. A horizontal tree assembly for supporting a production tubing string within a well, the tree assembly adapted for use with a pipe string for fluid communication with the tree assembly, the tree assembly comprising:

a production member defining a production member central bore for receiving therein a tubing hanger and a production member production passageway extending laterally from the production member central bore to a production valve;

the tubing hanger sealed to the production member and adapted for supporting the production tubing string therefrom, the tubing hanger having a tubing hanger bore in fluid communication with the production tubing string and a tubing hanger production passageway extending laterally from the tubing hanger bore for fluid communication with the lateral production passageway in the production member;

an annulus port extending laterally through the production member and in fluid communication with an annulus about the production tubing string;

an annulus valve for controlling fluid flow through the annulus port;

a workover flow path spaced from the tubing hanger bore and extending through the tubing hanger, the workover flow path communicating the production member central bore below the tubing hanger with the production member central bore above the tubing hanger, thereby providing fluid communication between an annulus surrounding the pipe string and the annulus surrounding the production tubing string; and a workover valve positioned along the workover flow path for controlling fluid flow between the production member central bore above the tubing hanger and the annulus surrounding the production tubing string below the tubing hanger, a first closure member within the bore in the tubing hanger;

a second closure member positioned above the first closure member; and wherein the first and second closure members are passable through the production member central bore.

72. An apparatus for use selectively with a blowout preventer and a subsea wellhead for controlling the flow of fluids in a subsea well and with a pipe string extending from the blowout preventer to the sea surface and tubing extending down into the subsea well, the pipe string and tubing each having a flowbore, the apparatus comprising:

a production member adapted for disposal between the subsea wellhead and the blowout preventer, the production member having a production member central bore formed by a wall of the production member and a production member production passageway and a production member annulus passageway, the production member annulus passageway extending laterally into the production member central bore;

a production valve disposed with the production member for controlling flow through the production member production passageway;

an annulus valve disposed with the production member for selective fluid flow through the production member annulus passageway;

a tubing hanger supported and sealed within the production member and suspending the tubing in the subsea well, the tubing hanger having a tubing hanger flowbore and the tubing forming a tubing annulus in the subsea well, the tubing hanger having a tubing hanger production passageway communicating the tubing hanger flowbore with the production member production passageway;

the production member annulus passageway communicating with the tubing annulus;

a workover flow path communicating the production member central bore extending below the tubing hanger with the production member central bore extending above the tubing hanger, thereby providing fluid communication between the tubing annulus and an annulus surrounding the pipe string;

the workover flow path passing through an aperture in the tubing hanger;

a workover valve disposed within the workover flow path for selective fluid circulation through the workover flow path;

a crossover flow path providing flow communication between the production member production passageway and the production member annulus passageway;

a crossover valve for controlling fluid flow through the crossover flow path; and fluid circulation paths being formed between the production member central bore and workover flow path to selectively circulate downhole using the tubing flowbore and tubing annulus.

73. The apparatus of claim 72 wherein the tubing hanger is mounted in a predetermined angular position within the central bore of the production member.

74. The apparatus of claim 72 further including a first flowpath extending through the pipe string and the flowbore of the tubing hanger and tubing and a second flowpath extending through the tubing annulus, the workover flow path, and the pipe string annulus to selectively circulate downhole.

75. The apparatus of claim 72 further including a first closure member mounted within the flow bore of the tubing hanger to control flow through the central bore of the production member; and a second closure member sealed and locked internally of the portion of the production member central bore above the tubing hanger.

76. A tree assembly as defined in claim 75 wherein the first and second closure members are passable through the production member central bore.

77. The apparatus of claim 72 further including a circulation flowpath formed through the tubing hanger flowbore with the production member production passageway closed and through the tubing annulus to selectively circulate fluid downhole using the tubing hanger flowbore and the tubing annulus; and the tubing hanger flowbore above the production member production passageway being adapted for isolation from the production member central bore above the production member production passageway.

78. The apparatus of claim 72 further including a circulation flowpath being formed upon establishing fluid communication between the tubing hanger and tubing flowbore and the pipe fluid bore, the circulation flowpath allowing flow through the tubing hanger and tubing flowbore and pipe bore and through the tubing annulus and production member annulus passageway for selective fluid circulation through the circulation flowpath.

79. A tree system for a wellhead for the completion and work-over of a subsea well, the tree system being adapted for connection to a blowout preventer having a BOP bore and a closure member for closing the BOP bore, the blowout preventer being connected to choke and kill lines extending from the BOP bore to the sea surface, the BOP bore receiving a tubular member extending to the sea surface and the closure member closing against the tubular member to form an annular bore, the tree system comprising:

a subsea tree having a bore adapted for installation on the wellhead;

a tubing hanger suspending tubing and supported by the subsea tree, seals sealing between the tubing hanger and the subsea tree, the tubing having an internal production bore and forming a tubing annulus extending downwardly into the well;

the subsea tree and tubing hanger forming a production flowpath in fluid communication with the tubing internal production bore and having a production control valve controlling flow therethrough;

the subsea tree forming an annulus flowpath in fluid communication with the tubing annulus and having an annulus control valve controlling flow therethrough;

a portion of the subsea tree bore being adapted to form a common flow passageway with the annular bore;

a workover flowpath extending from that portion of the subsea tree bore above the seals with that portion of the subsea tree bore below the seals and having a workover valve controlling flow therethrough; and said tubing hanger being adapted for fluid communication with the tubular member, the tubing internal production bore being adapted to form a common bore with the tubular member for selective fluid circulation downhole using the tubing internal production bore and tubing annulus in conjunction with at least one of the choke and kill lines extending from the BOP to the surface.

80. The tree system of claim 79 further including a fluid passageway to the surface being formed by the tubular member bore, tubing internal production bore, tubing annulus, workover flowpath, BOP bore, and one of the choke and kill lines.

81. The tree system of claim 79 further including a crossover flowpath interconnecting the tubing hanger and subsea tree production flowpath and an annulus passage in the subsea tree, the crossover flowpath having a crossover valve for controlling flow therethrough; and a fluid passageway being formed by the work string bore, tubing internal production bore, tubing annulus, annulus passage, crossover flowpath, and production flowpath.

82. The tree system of claim 79 wherein the BOP member is closed around the tubular member and further comprising a fluid passageway extending from the surface to the BOP bore through one of the choke and kill lines, another fluid passageway extending from the surface through the tubular member bore, tubing internal production bore, tubing annulus, workover flowpath to the BOP bore, and the other of the choke and kill lines extending from the BOP bore to the surface.

83. An apparatus for controlling the flow of fluids between the sea surface and a subsea well having a subsea wellhead suspending a casing at the subsea floor, comprising:

a subsea production member adapted to be removably disposed on the subsea wellhead by a subsea connector and having a bore forming a wall of the subsea production member, the wall having a lateral production port and at least one lateral annulus port therethrough, the lateral annulus port communicating with the surface;

a tubing hanger suspending tubing and supported within the bore of the production member the tubing hanger having a production aperture forming a tubing hanger wall and at least one access aperture extending from a lower end of the tubing hanger and into the tubing hanger wall;

the tubing having a flowbore and adapted to form a tubing annulus with the casing, the lateral annulus port communicating the tubing annulus with the surface;

the tubing hanger production aperture providing fluid communication between the tubing hanger flowbore and the production member lateral production port; and the tubing hanger access aperture forming at least a portion of a flow path providing flow communication between the tubing annulus and the production member bore above the tubing hanger; and further including a running tool connected to a pipe string for providing flow communication with the surface, the running tool being connected in flow communication with the tubing hanger and the running tool forming an annulus with the subsea production member.

84. The apparatus of claim 83 further including a blowout preventer having rams and a choke and kill line port in a wall of the blowout preventer, the choke and kill line port being connected to a choke or kill line extending to the surface.

85. The apparatus of claim 84 wherein the running tool annulus and choke or kill line are in flow communication with the tubing hanger access aperture to extend the flow path from the tubing annulus to the surface.

86. The apparatus of claim 84 further including a first fluid flow path extending from the subsea well and through the tubing, the tubing hanger production aperture, running tool and pipe string;

a second fluid flow path extending from the subsea well and through the tubing annulus, the tubing hanger access aperture, the running tool annulus, the choke and kill line port and the choke or kill line to the surface; and circulating fluids from the tubing annulus to the surface through the second fluid flow path.

87. An apparatus for controlling fluid flow between the sea surface and a subsea well having a subsea wellhead supporting a casing string at the subsea floor, comprising:

a first hanger suspended by the subsea wellhead at the subsea floor, the first hanger supporting a first pipe string within the well;

a mandrel removably connected to the subsea wellhead and having an aperture forming a mandrel wall and first and second lateral ports disposed in the wall;

a second hanger landed in the mandrel having first and second apertures, the first aperture in fluid communication with the first lateral port, the second hanger supporting a second pipe string within the subsea well and having a flow bore communicating with the first aperture and first lateral port, the first and second pipe strings forming an annulus;

the second aperture and second lateral port communicating with the annulus;

a first fluid flow path extending from the well and through the tubing flowbore, the first aperture, and first lateral port;

a second fluid flow path extending from the well and through the annulus and the second aperture and/or the second lateral port to the surface; and wherein the second fluid flow path allows circulation of fluids from the annulus to the surface.

88. A subsea well production assembly located between a subsea wellhead housing and a subsea blowout preventer and supporting a string of tubing extending into a subsea well and being connected to a work string extending to the surface of the sea, the blowout preventer having a lateral passageway communicating with a choke or kill line, the assembly comprising:

a production tree having a longitudinal axis, an axial bore and a lateral production passage, the lateral production passage having an inlet at the bore and extending laterally through a sidewall of the production tree;

the production tree further including an annulus bore through the sidewall of the production tree communicating with a crossover conduit communicating with the lateral production passage;

a tubing hanger landed in the axial bore and adapted to be located at an upper end of a string of tubing, the tubing hanger having a co-axial production passage co-axial with the production tree axial bore and extending axially through the tubing hanger and the tubing hanger having a lateral production passageway which extends laterally from the co-axial production passage through the tubing hanger and has an outlet at the exterior of the tubing hanger which registers with the inlet of the lateral production passage of the production tree;

the tubing hanger having an offset vertical passage extending through the tubing hanger from a lower end to an upper end of the tubing hanger offset from the co-axial production passage;

a first closure member installed in the co-axial production passage above the lateral production passageway of the tubing hanger; and a second closure member installed in the offset vertical passage.

89. A well production assembly located at an upper end of a string of tubing extending into a well, the assembly comprising:

a production tree having a longitudinal axis, an axial bore and first and second lateral passages, the first and second lateral passages having an inlet at the bore and extending laterally through a sidewall of the production tree;

a tubing hanger landed in the axial bore and adapted to be located at an upper end of a string of tubing, the tubing hanger having a co-axial production passage co-axial with the production tree axial bore and extending axially through the tubing hanger and the tubing hanger having a first lateral passageway which extends laterally from the co-axial production passage through the tubing hanger and has an outlet at the exterior of the tubing hanger which registers with the inlet of the first lateral passage of the production tree;

the tubing hanger having an offset passage extending through the tubing hanger from a lower end to an upper end of the tubing hanger offset from the co-axial production passage;

a first closure member installed in the co-axial production passage above the first lateral passage of the tubing hanger; and a second closure member installed in the offset passage above the second lateral passageway of the tubing hanger.

90. A flow completion apparatus for installation on a wellhead housing at an upper end of a well bore for controlling the flow of fluid through a tubing string which extends into the well bore and defines a tubing annulus surrounding the tubing string the flow completion apparatus comprising:

a tubing spool which is connected to the wellhead housing and which includes a central bore that extends axially therethrough, a production outlet which communicates with the central bore and an annulus passageway which communicates with the tubing annulus;

a tubing hanger which is supported in the central bore, is connected to an upper end of the tubing string, and includes a production bore which extends axially therethrough and a production passageway which communicates between the production bore and the production outlet;

a first closure member which is positioned in the production bore above the production passageway; and a first annular seal which is positioned between the tubing hanger and the central bore above the production passageway;

a workover passageway in the tubing spool communicating with a portion of the central bore that is located above the first annular seal;

a flow line which provides fluid communication between the workover passageway and annulus passageway;

whereby fluid communication between the tubing annulus and the top of the tubing hanger may be established through the annulus passageway flow line and workover passageway;

a BOP which is removably connectable to the top of the tubing spool and which includes a BOP bore, a first set of BOP rams, and at least one choke and kill line that communicates with a portion of the BOP bore which is located below the first BOP rams; and a tubing hanger running tool which is removably connectable to the top of the tubing hanger and which includes a cylindrical outer surface portion and a production port that communicates with the production bore;

wherein the first BOP rams are adapted to sealingly engage the outer surface portion above the production port;

whereby fluid communication between the tubing annulus and the BOP choke and kill line may be established through the annulus passageway, the flow line, the workover passageway, and the portion of the BOP bore which is located below the first BOP rams.

91. A flow completion apparatus for installation on a wellhead housing at an upper end of a well bore for controlling the flow of fluid through a tubing string which extends into the well bore and defines a tubing annulus surrounding the tubing string the flow completion apparatus comprising:

a tubing spool which is connected to the wellhead housing and which includes a central bore that extends axially therethrough, a production outlet which communicates with the central bore, and an annulus passageway which communicates with the tubing annulus;

a tubing hanger which is supported in the central bore, is connected to an upper end of the tubing string, and includes a production bore which extends axially therethrough and a production passageway which communicates between the production bore and the production outlet;

a first closure member which is positioned in the production bore above the production passageway; and a first annular seal which is positioned between the tubing hanger and the central bore above the production passageway;

a workover passageway in the tubing spool communicating with a portion of the central bore that is located above the first annular seal;

a flow line which provides fluid communication between the workover passageway and annulus passageway;

whereby fluid communication between the tubing annulus and the top of the tubing hanger may be established through the annulus passageway flow line and workover passageway;

a production closure member for controlling flow through the production outlet;

an annulus closure member for controlling flow through the annulus passageway;

a workover closure member for controlling flow through the workover passageway;

an outlet communicating with both the annulus closure member and workover closure member;

a crossover line extending from between the production closure member and the outlet; and a crossover closure member for controlling flow through the crossover line, wherein with the workover closure member and the remaining closure members open, a flow path may be established from the tubing annulus, through the annulus passageway, the outlet, the crossover line, the production outlet and the production bore;

a BOP which is removably connectable to the top of the tubing spool and which includes a BOP bore, a first set of BOP rams, and at least one choke and kill line that communicates with a portion of the BOP bore which is located below the first BOP rams; and a tubing hanger running tool which is removably connectable to the top of the tubing hanger and which includes a cylindrical outer surface portion, a production port that communicates with the production bore;

wherein the first BOP rams are adapted to sealingly engage the outer surface portion above the production port;

wherein with the tubing hanger closed below the tubing hanger, a circulation path may be established through the choke and kill line, the portion of the BOP bore which is located below the first rams, the flow path and the production port.

92. A horizontal tree assembly for supporting a production tubing string within a well, the tree assembly adapted for use with a pipe string for fluid communication with the tree assembly, the tree assembly comprising:

a production member defining a production member central bore for receiving therein a tubing hanger and a production member production passageway extending laterally from the production member central bore to a production valve;

the tubing hanger sealed to the production member and adapted for supporting the production tubing string therefrom, the tubing hanger having a first and second tubing hanger bores and a tubing hanger production passageway, the first tubing hanger bore being in fluid communication with the production tubing string and with the tubing hanger production passageway extending laterally from the first tubing hanger bore for fluid communication with the lateral production passageway in the production member;

a flow control apparatus controlling fluid flow through the second tubing hanger bore;

an annulus port extending laterally through the production member and in fluid communication with an annulus about the production tubing string;

an annulus valve for controlling fluid flow through the annulus port; and the first and second tubing hanger bores being arranged for workover in the well.

93. A tree assembly as defined in claim 92, further comprising:

a crossover flow line providing fluid communication between the annulus port and the production member production passageway; and a crossover valve for controlling fluid flow along the crossover flow line.

94. A tree assembly as defined in claim 92, further comprising a first closure member positioned within the first tubing hanger bore.

95. A tree assembly as defined in claim 94, further comprising a second closure member positioned above the tubing hanger and the first closure member isolating a bore between the first and second closure members.

96. A tree assembly as defined in claim 92, further comprising:

a first closure member within the bore in the tubing hanger; and a second closure member positioned above the first closure member.

97. A tree assembly as defined in claim 96 wherein the first and second closure members are passable through the production member central bore.

98. A horizontal tree assembly as defined in claim 92, wherein the second tubing hanger bore is controllable to stop fluid flow in either direction.

99. A horizontal tree assembly for supporting a production tubing string within a well, the tree assembly adapted for use with a pipe string for fluid communication with the tree assembly and a blowout preventer, the tree assembly comprising:

a production member defining a production member central bore for receiving therein a tubing hanger and a production member production passageway extending laterally from the production member central bore to a production valve;

the production valve being located outside the production member central bore a tubing hanger being sealed to the production member and adapted for supporting the production tubing string therefrom, the tubing hanger having a tubing hanger bore in fluid communication with the production tubing string and a tubing hanger production passageway extending laterally from the tubing hanger bore for fluid communication with the production passageway in the production member;

an annulus port extending laterally through the production member and in fluid communication with an annulus about the production tubing string;

an annulus valve for controlling fluid flow through the annulus port;

a wellhead control line extending laterally from the production member wall and connecting to the tubing hanger, and the wellhead control line being disconnectable from the tubing hanger and the tubing hanger being removable from the production member through the blowout preventer without removing the blowout preventer.

100. A method for the workover of a well comprising:

retreiving a debris cap on a horizontal tree;

lowering a drilling blowout preventer on a riser;

removing an internal tree plug through a bore of the blowout preventer previouusly installed in a central bore of the horizontal tree;

lowering a work string with a connector through the riser and blowout preventer;

latching the connector onto a tubing hanger landed and sealed within the central bore of the horizontal tree and suspending tubing in the well;

removing a tubing hanger plug in the tubing hanger vertical bore;

circulating the well around the seals sealing the tubing hanger and horizontal tree;

pulling the tubing hanger and tubing from the well through the blowout preventer and riser;

performing workover in the well;

lowering a tubing hanger with tubing through the riser and blowout preventer and installing the tubing hanger in the central bore of the horizontal tree;

circulating the well around the seals sealing the tubing hanger and horizontal tree;

setting a tubing hanger plug in the tubing hanger;

setting an internal tree plug in the central bore of the horizontal tree;

testing the seals and plugs;

pulling the drilling blowout preventer and riser; and setting the debris cap on the horizontal tree, all steps being performed without a workover blowout preventer or workover riser.

101. The method of claim 100 comprising:

forming a common flow passageway between a BOP bore in the blowout preventer and a portion of the horizontal tree bore above the seals around the tubing hanger;

closing the blowout preventer around the work string;

forming a flowpath through the tubing and the work string, forming an annular area between the work string and the horizontal tree in the common flow passageway and forming an annulus around the tubing below the tubing hanger;

forming a production passageway through the tubing, through a lateral port in the tubing hanger and through the wall of the horizontal tree;

controlling flow through the production passageway by a production valve;

forming an annulus passageway from the annulus and through the wall of the subsea tree;

controlling flow through the annulus passageway by an annulus valve;

forming a workover passageway from the annular area between the tubular member and subsea tree and through the wall of the subsea tree;

controlling flow through the workover passageway;

providing fluid communication between the workover passageway and the annulus passageway; and circulating fluid downhole using the flowpath, tubing annulus, annulus passageway, workover passageway, and annular area.

102. The method of claim 100 further including circulating through the common flow passageway and through a choke or kill line.

103. The method of claim 100 further including forming a crossover fluid passageway between the production passageway and annulus passageway; controlling flow through the crossover fluid passageway; and flowing fluid downhole through the workover passageway, the crossover passageway, and the production passageway.

104. A workover assembly for repairing a well having a wellhead housing and for use with a blowout preventer having a BOP bore, the assembly comprising:

a horizontal tree fixed and sealed to the wellhead housing, the horizontal tree having a wall with a central bore therethrough and a lateral bore connected to a valve, the blowout preventer being mounted on the horizontal tree and the central bore forming a common passageway with the BOP bore;

a tubing hanger landed and sealed within the horizontal tree with a lateral port in the tubing hanger in alignment with the lateral bore in the horizontal tree, the tubing hanger supporting tubing;

a sealing member sealing at least one vertical bore in the tubing hanger above the lateral port;

an internal tree cap sealing the central bore through the horizontal tree above the tubing hanger, the sealing member and internal tree cap being retrievable through the BOP bore;

a workover port extending through the wall of the horizontal tree for selective fluid circulation with that portion of the common passageway below the BOP bore and above the tubing hanger; and an annulus port extending through the wall of the horizontal tree for selective fluid circulation with an annulus around the tubing, the workover and annulus ports being interconnected via a flow passageway having at least one valve.

* * * * *